US005913399A

United States Patent [19]

Takemoto et al.

[11] Patent Number: 5,913,399

[45] Date of Patent: Jun. 22, 1999

[54] COIN HANDLING MECHANISM FOR SUPPLYING COINS TO COIN GAME MACHINES AND COLLECTING COINS THEREFROM AND GAMING FACILITY HAVING THE SAME

[75] Inventors: Takatoshi Takemoto, Tokyo; Hideyuki Kadomatsu, Odawara; Yukio Manzaki, Yokosuka, all of Japan

[73] Assignee: Kabushiki Kaisha Ace Denken, Tokyo, Japan

[21] Appl. No.: 08/809,541

[22] PCT Filed: Sep. 22, 1994

[86] PCT No.: PCT/JP94/01564

§ 371 Date: Mar. 21, 1997

§ 102(e) Date: Mar. 21, 1997

[87] PCT Pub. No.: WO96/09099

PCT Pub. Date: Mar. 28, 1996

[51] Int. Cl.[6] ..... G07F 17/34

[52] U.S. Cl. ..... 194/200; 221/21; 453/17

[58] Field of Search ..... 194/200, 202; 453/17, 32, 56, 57, 63; 221/21

[56] References Cited

U.S. PATENT DOCUMENTS 4,342,384 8/1982 Fukase et al. ..... 453/56

FOREIGN PATENT DOCUMENTS 287049 10/1988 European Pat. Off. ..... 453/32

55-166286 11/1980 Japan .

62-31392 7/1987 Japan .

2-84983 3/1990 Japan .

3-97479 4/1991 Japan .

3-155884 7/1991 Japan .

4-319380 11/1992 Japan .

*Primary Examiner*—F. J. Bartuska

*Attorney, Agent, or Firm*—Seed & Berry LLP

[57] ABSTRACT

A gaming facility having a plurality of coin game machines (100) and a coin handling mechanism (200) for supplying coins to the coin game machines and collecting coins therefrom is disclosed. The coin handling mechanism comprises a coin collection transporter (210) for collecting coins input for playing games, a coin replenishment transporter (230) for transporting coins with which the coin game machines are replenished, a replenishment coin supply unit (240) for supplying coins to the coin replenishment transporter, coin branch units (250) for making coins transported by the coin replenishment transporter branch therefrom into the corresponding coin game machines, and a controller (300) for at least controlling coin replenishment. The controller comprises elements that cooperate to control a coin supply for dispensing coins to the coin replenishment transporter from the replenishment coin supply unit and elements that cooperate to control coin branching for making coins transported by the coin replenishment transporter branch therefrom into the corresponding coin game machines.

35 Claims, 17 Drawing Sheets

*Fig. 9*

| | | OPERATION STATE WHEN JAM OCCURS | | | | | |
|---|---|---|---|---|---|---|---|
| | | SUPPLY HOPPER MOTOR | REPLENISHMENT CONVEYOR MOTOR | COIN BRANCH UNIT | COLLECTION CONVEYOR MOTOR | COIN LIFT MOTOR | |
| REPLENISHMENT CONVEYOR JAM | ① | STOP | NORMAL | NORMAL | NORMAL | NORMAL | AUTOMATIC RECOVERY AFTER JAM IS CLEARED |
| COIN BRANCH UNIT JAM | ② | STOP | NORMAL | STOP | NORMAL | NORMAL | " |
| COLLECTION CONVEYOR JAM | ③ | STOP | STOP | NORMAL | NORMAL | NORMAL | " |
| COIN LIFT JAM | ④ | STOP | STOP | NORMAL | STOP | NORMAL | " |

*Fig. 10*

| | OPERATION STATE WHEN ERROR OCCURS | | | | | |
|---|---|---|---|---|---|---|
| | SUPPLY HOPPER MOTOR | REPLENISHMENT CONVEYOR MOTOR | COIN BRANCH UNIT | COLLECTION CONVEYOR MOTOR | COIN LIFT MOTOR | |
| REPLENISHMENT CONVEYOR MOTOR | STOP | STOP | NORMAL | NORMAL | NORMAL | RESTART AFTER JAM IS CLEARED |
| COLLECTION CONVEYOR JAM | STOP | STOP | NORMAL | STOP | NORMAL | " |
| COIN LIFT MOTOR | STOP | STOP | NORMAL | STOP | STOP | " |

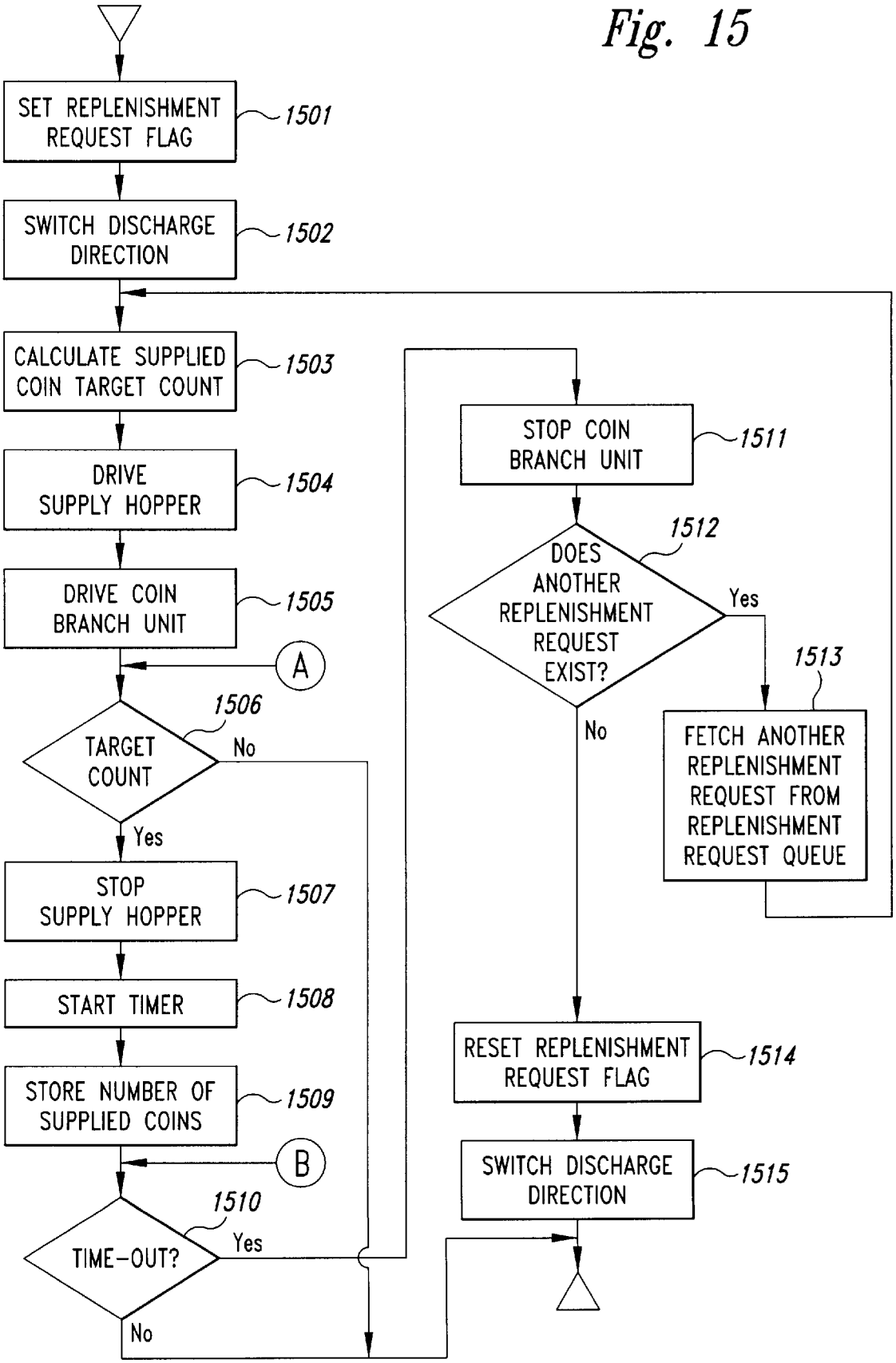
Fig. 15
SET REPLENISHMENT REQUEST FLAG
1501
SWITCH DISCHARGE DIRECTION
1502
CALCULATE SUPPLIED COIN TARGET COUNT
1503
DRIVE SUPPLY HOPPER
1504
DRIVE COIN BRANCH UNIT
1505
A
TARGET COUNT
1506
No
Yes
STOP SUPPLY HOPPER
1507
START TIMER
1508
STORE NUMBER OF SUPPLIED COINS
1509
B
TIME-OUT?
1510
Yes
No
STOP COIN BRANCH UNIT
1511
DOES ANOTHER REPLENISHMENT REQUEST EXIST?
1512
Yes
No
FETCH ANOTHER REPLENISHMENT REQUEST FROM REPLENISHMENT REQUEST QUEUE
1513
RESET REPLENISHMENT REQUEST FLAG
1514
SWITCH DISCHARGE DIRECTION
1515

COIN HANDLING MECHANISM FOR SUPPLYING COINS TO COIN GAME MACHINES AND COLLECTING COINS THEREFROM AND GAMING FACILITY HAVING THE SAME

TECHNICAL FELD

This invention relates to a gaming facility having a coin game machine group where a plurality of coin game machines are placed and a coin handling mechanism for supplying and collecting coins to and from the coin game machines, and in particular to an improved coin handling mechanism and a gaming facility equipped with the improved coin handling mechanism

RELATED ART

If a given condition is satisfied at a coin game machine for a player to play games with coins, such as a slot machine, namely, the player wins a game, a given quantity of coins are paid out to the player for the winning game play. Thus, the coin game machine of this kind needs to store coins to be paid out for winning game plays and coins input to the gaming machine for playing games. Thus, conventional coin game machines comprise tanks for storing coins.

Incidentally, if such a conventional coin game machine becomes short of coins, personnel replenish the coin game machine with coins. If coins overflow the tank, personnel collect the coins. However, a problem is that personnel replenishing the gaming machine with coins and collecting the coins therefrom incurs expense in effort. If the gaming machine becomes short of coins or coins overflow the tank while a player is playing a game, the game played at the gaming machine must be interrupted to replenish or collect coins.

For this reason, a system for automatically replenishing a plurality of coin game machines with coins and collecting coins therefrom is proposed. Examples of such a system are disclosed in Japanese Utility Model Laid-Open No. 55-166286 (corresponding U.S. patent: U.S. Pat. No. 4,342,384) and Japanese Patent Publication No. 62-31392.

In the arts disclosed here, a tank for storing coins is provided for each slot machine and coins input to the slot machine can be guided into the tank for circulation. If excessive coins are stored in the tank, the coins input to the slot machine are guided into a collection conveyor by switching a switch and are stored in a collection tank common to the slot machines. If the tank of any slot machine becomes short of coins, it is replenished with coins from the common collection tank through a transporter.

However, according to the prior art, a switch is required for diverting input coins from the tank to the collection conveyor or from the collection conveyor to the tank, increasing the cost of the system accordingly, and there is a fear that a coin jam will occur at the switch.

To recycle input coins in the same slot machine, a guide passage is required for guiding the coins into the tank of the slot machine, complicating the structure and requiring extra parts, leading to an increase in manufacturing costs.

Further, in the conventional replenishment mechanism, coins are replenished or collected simply depending on an excess or shortage of coins detected by a sensor. That is, sufficient management of the coins in quantities such as the number of replenished coins, the number of paid-out coins, and the number of input and collected coins was not done.

DISCLOSURE OF INVENTION

It is an object of the invention to provide a coin handling mechanism having a structure as simple as possible, for reducing a cost and making it difficult for a coin jam to occur, and capable of executing number-of-coins management for actually handled coins, as well as a gaming facility having the coin handling mechanism.

To accomplish the object, according to a first aspect of the invention, there is provided coin handling mechanism being placed in a gaming house having at least one coin game machine group containing a plurality of coin game machines for supplying coins to the coin game machines belonging to the coin game machine group and collecting coins from the coin game machines, the coin handling mechanism comprising:

- a coin collection transporter for receiving coins input for playing a game in each coin game machine and transporting and collecting the coins;
- a coin replenishment transporter for transporting coins with which the coin game machines belonging to the coin game machine group are replenished;
- a replenishment coin supply unit for storing replenishment coins and supplying coins to the coin replenishment transporter;
- coin branch units being provided in a one-to-one correspondence with the coin game machines for making coins transported by the coin replenishment transporter branch therefrom into the corresponding coin game machines;
- a number-of-supplied-coins counter for counting the number of coins discharged from the replenishment coin supply unit;
- a number-of-collected-coins counter for counting the number of coins collected at the coin collection transporter; and
- a controller for at least controlling coin replenishment, the controller comprising:

- coin supply control means for accepting a request for replenishing any coin game machine with coins and dispensing coins to the coin replenishment transporter from the replenishment coin supply unit until acceptance of a coin replenishment stop request; and
- coin branch control means for accepting a request for replenishing any coin game machine with coins and causing the coin branch unit corresponding to the coin game machine to make coins transported by the coin replenishment transporter branch therefrom into the coin game machine.

According to a second aspect of the invention, there is provided a gaming facility having a coin game machine group to which a plurality of coin game machines belong and a coin handling mechanism for supplying coins to the coin game machines and collecting coins therefrom, characterized in that each of the coin game machines comprises:

- a coin acceptor for accepting coin input;
- a game execution section for executing a predetermined game provided that coin input is accepted by the coin acceptor and outputting a winning signal instructing a predetermined number of coins to be paid out if a player wins a game play;
- a coin dispenser for dispensing a predetermined number of coins in response to the winning signal; and
- a coin return for receiving and holding coins dispensed from the coin dispenser, the coin dispenser having a dispensing hopper for storing at least as many coins as required for one dispensing operation and upon acceptance of winning information, dispensing as many coins as the number specified by the winning information to the coin return, and that the coin handling mechanism comprises:

a coin collection transporter for receiving coins input to the coin acceptor therefrom and transporting and collecting the coins;

a coin replenishment transporter for transporting coins with which the coin game machines are replenished;

a replenishment coin supply unit for storing replenishment coins and supplying coins to the coin replenishment transporter;

coin branch units being provided in a one-to-one correspondence with the coin game machines for making coins transported by the coin replenishment transporter branch therefrom into the corresponding coin dispensers;

a number-of-supplied-coins counter for counting the number of coins discharged from the replenishment coin supply unit;

a number-of-collected-coins counter for counting the number of coins collected at the coin collection transporter; and a controller for at least controlling coin replenishment, the controller comprising:

coin supply control means for accepting a request for replenishing any coin game machine with coins and dispensing coins to the coin replenishment transporter from the replenishment coin supply unit until acceptance of a request to stop replenishing the coin game machine with coins; and coin branch control means for accepting a request for replenishing any coin game machine with coins and causing the coin branch unit corresponding to the coin game machine to make coins transported by the coin replenishment transporter branch therefrom into the corresponding coin dispenser until acceptance of a request to stop replenishing the coin game machine with coins.

According to a third aspect of the invention, there is provided a coin handling mechanism being placed in a gaming house having at least one coin game machine group containing a plurality of coin game machines for supplying coins to the coin game machines belonging to the coin game machine group and collecting coins from the coin game machines, the coin handling mechanism comprising:

a coin collection transporter for receiving coins input for playing a game in each coin game machine and transporting and collecting the coins;

a coin replenishment transporter for transporting coins with which the coin game machines belonging to the coin game machine group are replenished;

a replenishment coin supply unit for storing replenishment coins and supplying coins to the coin replenishment transporter;

coin branch units being provided in a one-to-one correspondence with the coin game machines for making coins transported by the coin replenishment transporter branch therefrom into the corresponding coin game machines;

a number-of-supplied-coins counter for counting the number of coins discharged from the replenishment coin supply unit;

a number-of-collected-coins counter for counting the number of coins collected at the coin collection transporter; and a controller for at least controlling coin replenishment, the controller comprising:

coin supply control means for accepting a request for replenishing any coin game machine with coins and dispensing a predetermined number of coins to the coin replenishment transporter from the replenishment coin supply unit by making reference to a count of the number-of-supplied-coins counter; and coin branch control means for accepting a request for replenishing any coin game machine with coins and causing the coin branch unit corresponding to the coin game machine to make coins transported by the coin replenishment transporter branch therefrom into the coin game machine.

Further, according to a fourth aspect of the invention, there is provided a gaming facility having a coin game machine group to which a plurality of coin game machines belong and a coin handling mechanism for supplying coins to the coin game machines and collecting coins therefrom, characterized in that each of the coin game machines comprises:

a coin acceptor for accepting coin input;

a game execution section for executing a predetermined game provided that coin input is accepted by the coin acceptor and outputting a winning signal instructing a predetermined number of coins to be paid out if a player wins a game play;

a coin dispenser for dispensing a predetermined number of coins in response to the winning signal; and a coin return for receiving and holding coins dispensed from the coin dispenser, the coin dispenser having a dispensing hopper for storing at least as many coins as required for one dispensing and upon acceptance of winning information, dispensing operation as many coins as the number specified by the winning information to the coin return, and that the coin handling mechanism comprises:

a coin collection transporter for receiving coins input to the coin acceptor and transporting and collecting the coins;

a coin replenishment transporter for transporting coins with which the coin game machines are replenished;

a replenishment coin supply unit for storing replenishment coins and supplying coins to the coin replenishment transporter;

coin branch units being provided in a one-to-one correspondence with the coin game machines for making coins transported by the coin replenishment transporter branch therefrom into the corresponding coin dispensers;

a number-of-supplied-coins counter for counting the number of coins discharged from the replenishment coin supply unit;

a number-of-collected-coins counter for counting the number of coins collected at the coin collection transporter; and a controller for at least controlling coin replenishment, the controller comprising:

coin supply control means for accepting a request for replenishing any coin game machine with coins and dispensing a predetermined number of coins to the coin replenishment transporter from the replenishment coin supply by making reference to a counter of the number-of-supplied-coins counter; and coin branch control means for accepting a request for replenishing any coin game machine with coins and causing the coin branch unit corresponding to the coin game machine to make coins transported by the coin replenishment transporter branch therefrom into the coin game machine.

The coin handling mechanism and the gaming facility of the invention assume use of coins accepted as the actual currency, but tokens, such as medals not usable as normal currency, may also be used.

BREF DESCRIPTION OF THE DRAWINGS

FIG. 9 is an illustration showing an example of a list of equipment whose operation is to be stopped when a jam occurs;

FIG. 10 is an illustration showing an example of a list to show equipment whose operation is to be stopped when a motor error occurs;

FIG. 15 is a flowchart showing a replenishment procedure in a second embodiment of the invention;

BEST MODE FOR CARRYING OUT THE INVENTION

Referring now to the accompanying drawings, there are shown embodiments of the best mode for carrying out the invention.

In the following embodiments we will discuss a gaming facility having a plurality of coin game machines and a coin handling mechanism used with the gaming facility. In the embodiments, slot machines are used as the coin game machines. The invention can also be applied to gaming machines other than the slot machines. In the embodiments, coins accepted as the currency are used, but tokens shaped like coins may also be used.

Figure 1:
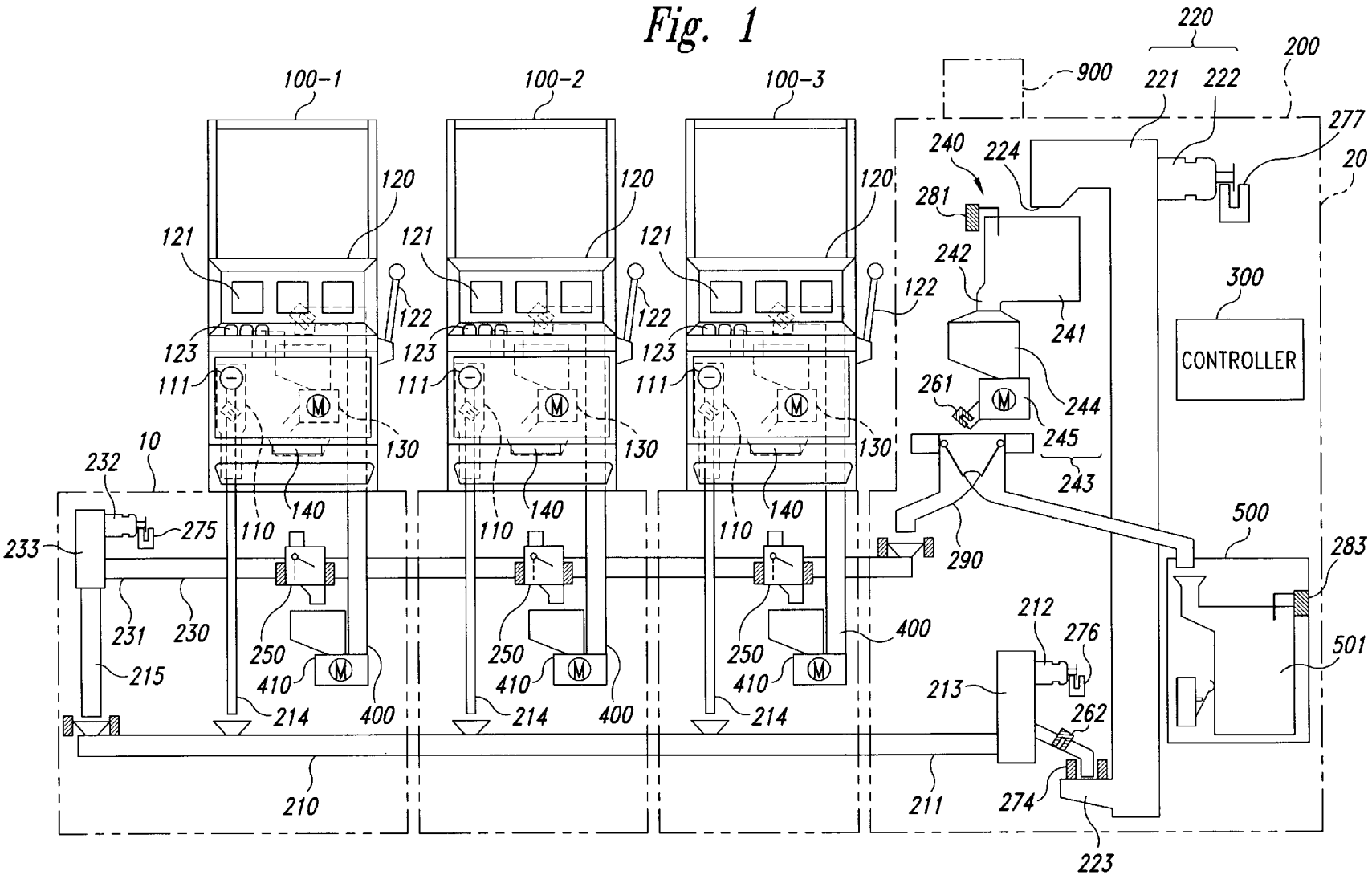
FIG. 1 is an illustration showing a gaming facility of a first embodiment of the invention and a coin handling mechanism used with the gaming facility.
Figure 2:
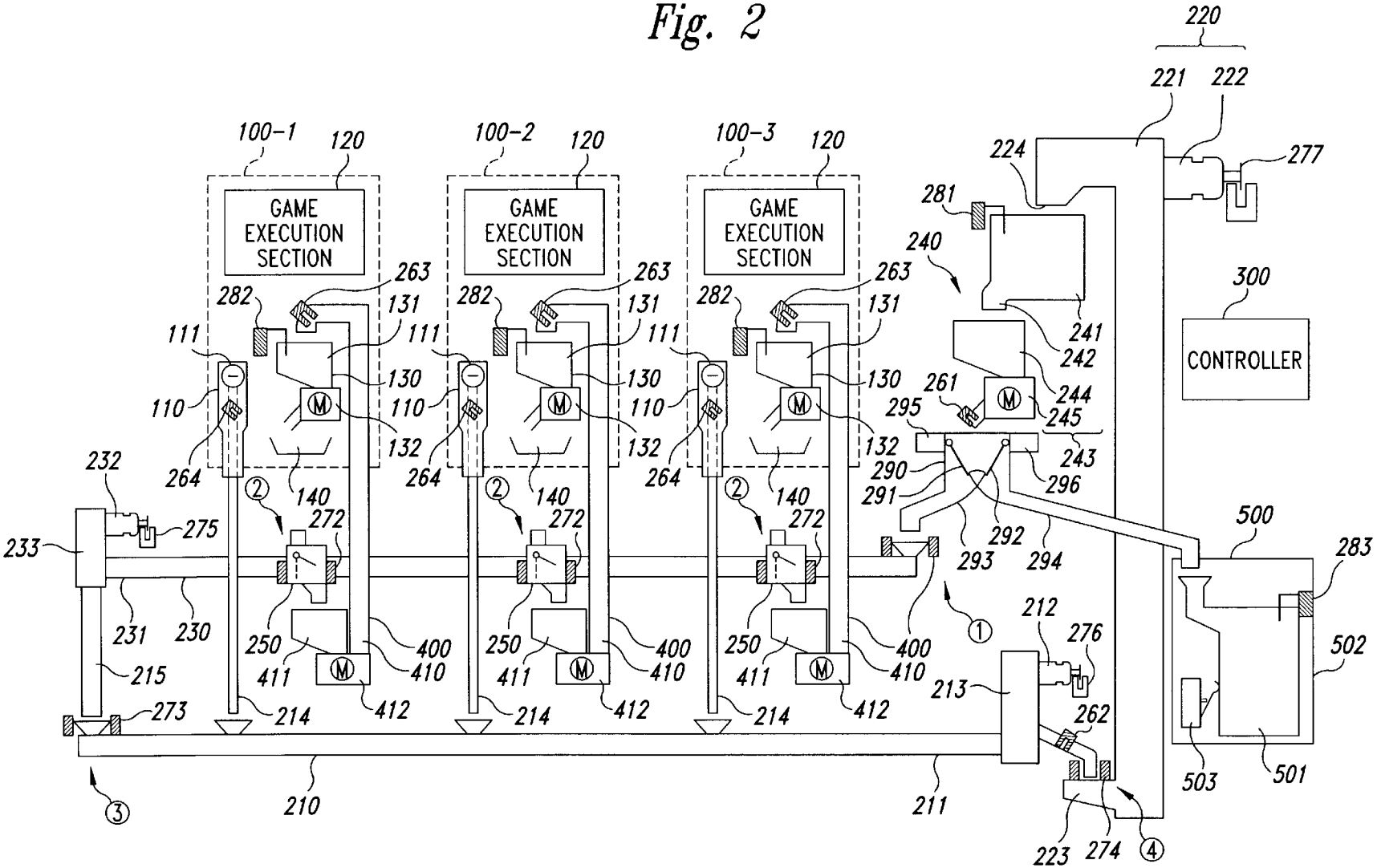
FIG. 2 is an illustration showing the gaming facility of the first embodiment of the invention and the coin handling mechanism used with the gaming facility in detail.

FIGS. 1 and 2 show a gaming facility of a first embodiment of the invention. As shown in FIG. 1, the gaming facility of the embodiment have a slot machine group to which a plurality of slot machines 100-1, 100-2, and 100-3 belong and a coin handling mechanism 200 for supplying and collecting coins to and from the slot machines 100-1, 100-2, and 100-3. Each of the slot machines 100-1, 100-2, and 100-3 is placed on a cabinet 10 made up of a frame and a cover board, although not shown in detail. Some components of the coin handling mechanism 200 are accommodated in the cabinets 10, namely, they are placed below the slot machines 100. Other components of the coin handling mechanism 200 are accommodated in another cabinet 20 disposed adjoining the cabinet 100. Of course, the cabinets 10 and 20 may be constructed integrally.

In the first embodiment and other embodiments below, three slot machines 100 are installed for convenience, but the number of slot machines installed is not limited to three. Generally, a larger number of slot machines belong to one slot machine group. In the embodiment, the slot machines are placed on a row. However, they may be placed on two rows. The slot machines differ only in placement position; they are the same in constitution. A plurality of gaming facilities of this kind are placed in a gaming house.

The slot machine 100 comprises a coin acceptor 110 for accepting coin input, a game execution section 120 for executing a predetermined game provided that coin input is accepted by the coin acceptor 110 and outputting a winning signal instructing a predetermined number of coins to be paid out if a player wins a game play, a coin dispenser 130 for paying out a predetermined number of coins in response to the winning signal, and a coin return 140 being placed in the coin dispenser 130 for receiving and holding coins paid out from the coin dispenser 130.

The coin acceptor 110 has a coin inlet 111 for inputting coins and a coin selector 112 (see FIG. 3) for selecting only coins available with the slot machine from the input coins, counting the selected coins, sending the count to the game execution section 120, and returning unselected coins.

Figure 3:
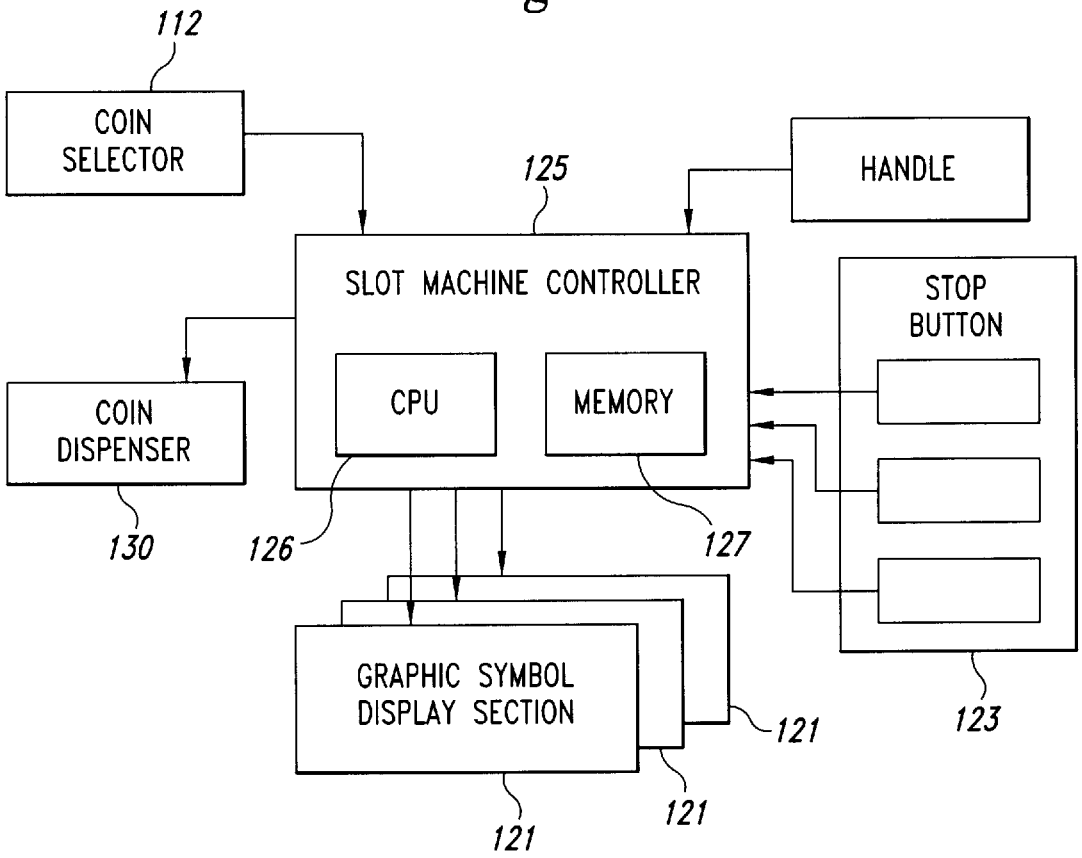
FIG. 3 is a block diagram showing the hardware system constitution of a game execution section of a slot machine used in embodiments of the invention.

The game execution section 120 has three graphic symbol display sections 121 each for displaying several kinds of graphic symbols dynamically, a handle 122 for giving an instruction for starting dynamic display of graphic symbols, stop buttons 123 for giving an instruction for stopping dynamic display of graphic symbols on each of the graphic symbol display sections, and a slot machine controller 125 (see FIG. 3).

The slot machine controller 125 has at least a central processing unit (CPU) 126 and a memory 127, as shown in FIG. 3. The coin selector 112, the handle 122, the stop buttons 123, the graphic symbol display sections 121, and the coin dispenser 130 are connected to the slot machine controller 125.

The CPU 126 inputs the coin count from the coin selector 112 and recognizes the amount of a bet; accepts a start instruction of the handle 122 and stop instructions of the stop buttons 123; controls dynamic display of graphic symbols on the graphic symbol display sections 121; controls starting and stopping thereof; determines a winning game play when the dynamic display stops; sends winning information to the coin dispenser 130 when a player wins a game play, etc. For the winning information, the winning amount of money determined by a bet and odds, or the number of paid-out coins equivalent to the winning amount, or any other equivalent information is output, for example. The embodiment assumes that the information indicating the number of paid-out coins is output.

In FIG. 2, the coin dispenser 130 is made of a dispensing hopper for storing at least as many coins as required for one dispensing (payout) and upon acceptance of winning information, dispensing as many coins as the number specified by the winning information to the coin return 140. The coin dispenser 130 is provided with a coin quantity detection sensor 282 for detecting the quantity of stored coins.

The coin dispenser (dispensing hopper) 130 has a coin storage section 131 for storing coins and a coin sending-out section 132 for sending out the stored coins one at a time. The coin storage section 131 can store a larger number of coins than the number of coins dispensed at one time. For example, about several hundred to a thousand and several hundred coins can be stored, although the number also varies depending on the coin size. The coin sending-out section 132 is provided with a counter of the number of coins (not shown). Thus, it stops upon completion of sending out as many coins as the number specified by the information indicating the number of dispensed coins sent out from the slot machine controller 125.

The coin return 140, which is located on the outside of the front of the slot machine 100 as shown in FIG. 1, receives coins sent out from the dispensing hopper 130 and temporarily stores the coins inside. A player can input the coins in the coin return 140 to the coin acceptor 110 for playing a game.

The coin handling mechanism 200 comprises a coin collection transporter 210 for receiving coins input to the coin acceptors 110 in the slot machines 100, and transporting and collecting the coins; a coin replenishment transporter 230 for transporting coins with which the slot machines 100 are replenished; a replenishment coin supply unit 240 for storing replenishment coins and supplying coins to the coin replenishment transporter 230; coin branch units 250 provided in a one-to-one correspondence with the slot machines 100 for making coins transported by the coin replenishment transporter 230 branch therefrom into the corresponding slot machines and sending the coins to the corresponding coin dispensers 130; counters 261, 262, 263, and 264; jam detection and motor monitor sensors 271, 272, and 273; coin quantity detection sensors 281, 282, and 283; and a controller 300 (see FIG. 4) for at least controlling replenishment with coins.

In the embodiment, the coin handling mechanism 200 further includes transporters 400 provided for sending coins made to branch by the corresponding coin branch units 250 to the insides of the corresponding slot machines 100, a spare tank 500 for storing an excess of coins stored in a coin holding vessel of the replenishment coin supply unit 240 (described later) exceeding a predetermined upper limit reference quantity (overflowing coins) and coins collected as sales, and a discharge direction switch 290 for switching coins discharged from the replenishment coin supply unit 240 into the coin replenishment transporter 230 or the spare tank 500.

The coin collection transporter 210 comprises a collection conveyor (first conveyor) 211 for transporting coins, a motor 212 for driving the collection conveyor 211, a power transfer mechanism 213 for transferring power of the motor 212 to the collection conveyor 211, and a coin lifter 220 for further transporting coins transported on the collection conveyor 211 to a coin holding vessel 241 (described later) and storing the coins therein. It further includes guide pipes 214 for guiding coins selected as available coins in the coin selector 112 to the collection conveyor 211 and a collection passage 215 for collecting coins not made to branch by the coin branch units 250 and remaining between the termination of the coin replenishment transporter 230 and the collection conveyor 211 and guiding these coins to the collection conveyor 211.

In the coin collection transporter 210, the collection conveyor 211 is placed along the row of slot machines 100 and is driven by the motor 212 for transporting coins. The drive state of the motor 212 is monitored by a motor monitor sensor 276 (described later).

The coin lifter 220 has a lift mechanism 221 having a belt provided with a large number of buckets and a motor 222 for driving the lift mechanism 221. The lift mechanism 221 has at the bottom a coin reception part 223 for receiving coins sent out from the front-end of the collection conveyor 211. The coin lifter 220 is provided at the top with an outlet 224 opened downward for discharging coins transported by the lift mechanism 221.

The coin replenishment transporter 230 has a replenishment conveyor 231 (second conveyor) for transporting coins, a motor 232 for driving the replenishment conveyor 231, and a power transfer mechanism 233 for transferring power of the motor 232 to the replenishment conveyor 231. The replenishment conveyor 231 is placed along the row of the slot machines 100 and is driven by the motor 232 for transporting coins. The drive state of the motor 232 is monitored by a motor monitor sensor 275 (described later).

The replenishment coin supply unit 240 comprises a coin holding vessel 241 for storing replenishment coins and discharging coins and a supply hopper 243 for accepting and temporarily storing coins discharged from the coin holding vessel 241 and supplying coins to the coin replenishment transporter 230. The coin holding vessel 241 has a coin discharge part 242 at the bottom. The coin discharge part 242 is connected to an opening of the supply hopper 243. That is, the coin holding vessel 241 and the supply hopper 243 communicate with each other via a narrow passage. Thus, most of the weight of the coins stored in the coin holding vessel 241 is supported on the bottom of the coin holding vessel 241 and the weight hardly affects the supply hopper 243. Moreover, coins can be moved to the supply hopper 243 through the coin discharge part 242 communicating therewith. Resultantly, if the coin quantity in the supply hopper 243 decreases, coins drop naturally from the coin holding vessel 241 for automatically replenishing the supply hopper 243 with coins.

The supply hopper 243 has a coin storage section 244 for storing coins and a coin sending section 245 for sending out the stored coins one at a time. The coin storage section 244 can store a larger number of coins than the number of coins that can be dispensed at a time (for example, about several hundred coins). The coin sending section 245 is provided with a counter 261 for counting the number of coins sent out.

The discharge direction switch 290 is placed between the supply hopper 243 and the replenishment conveyor 231 of the coin replenishment transporter 230. It switches coins discharged from the supply hopper 243 into the coin replenishment transporter 230 or the spare tank 500. The discharge direction switch 290 has a first passage 293 for guiding coins to the replenishment conveyor 231, a second passage 294 for guiding coins to the spare tank 500, a valve 291 for opening and closing the first passage 293, a valve 292 for opening and closing the second passage 294, and drive sections 295 and 296 for opening and closing the valves 291 and 292.

The spare tank 500 has a tank main unit 501 for storing coins, a tank case 502 for housing the tank main unit 501 detachably, and a tank detection sensor 503 for detecting the tank main unit 501 being housed in the tank case 502. The tank detection sensor 503 goes on, when the tank main unit 501 is attached to the tank case 502, and off, when the tank main unit 501 is detached from the tank case 502. It can be made of a microswitch, for example.

The coin branch units 250, which are placed along the replenishment conveyor 231, make coins transported on the replenishment conveyor 231 branch therefrom into the corresponding transporters based on an instruction from the controller 300, namely, in response to a coin replenishment request, if made.

Figure 6:
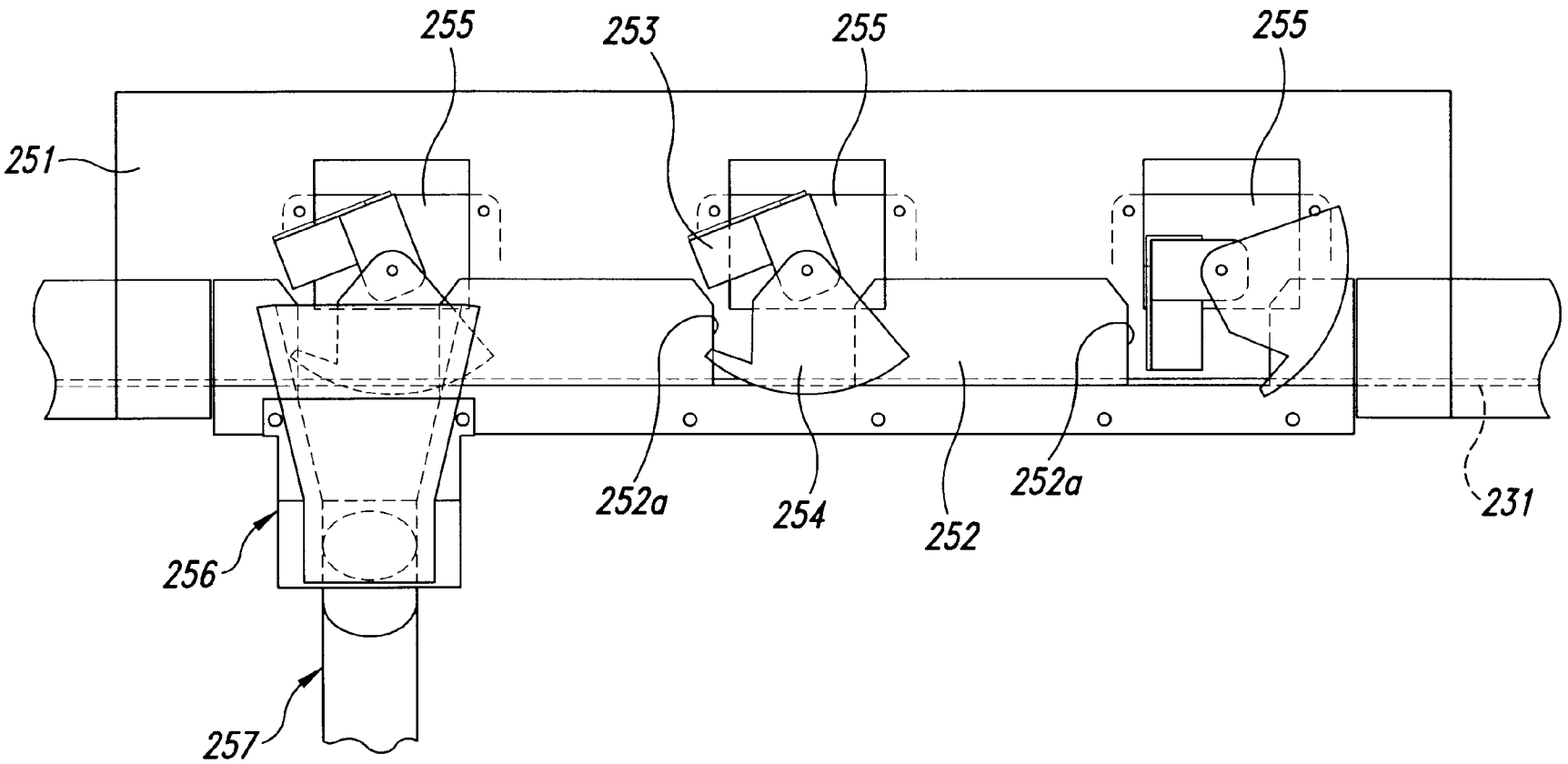
FIG. 6 is a front view showing the constitutions of coin branch units used in each embodiment of the invention.
Figure 7:
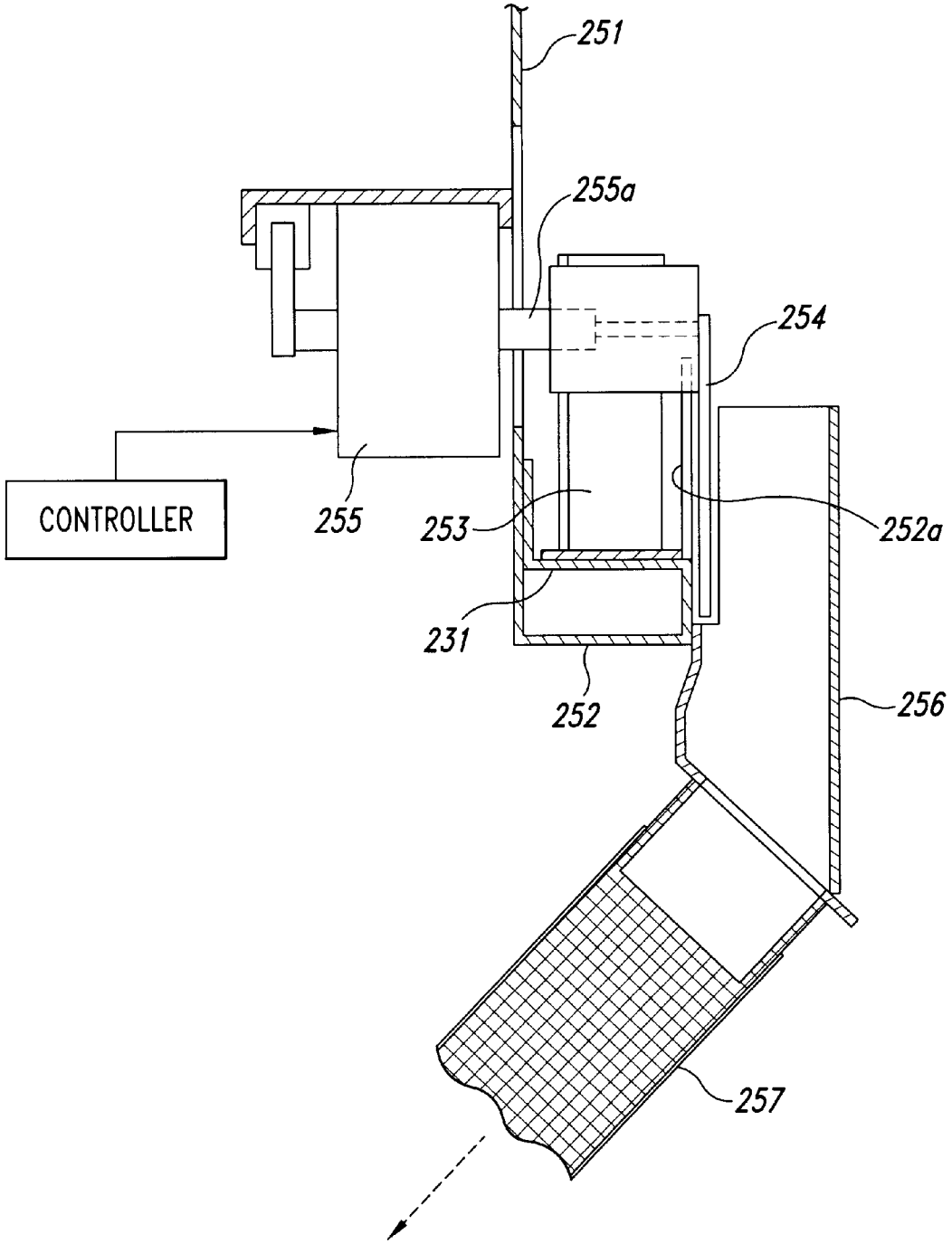
FIG. 7 is a sectional view showing the detailed constitution of the coin branch unit used in each embodiment of the invention.
Figure 8A:
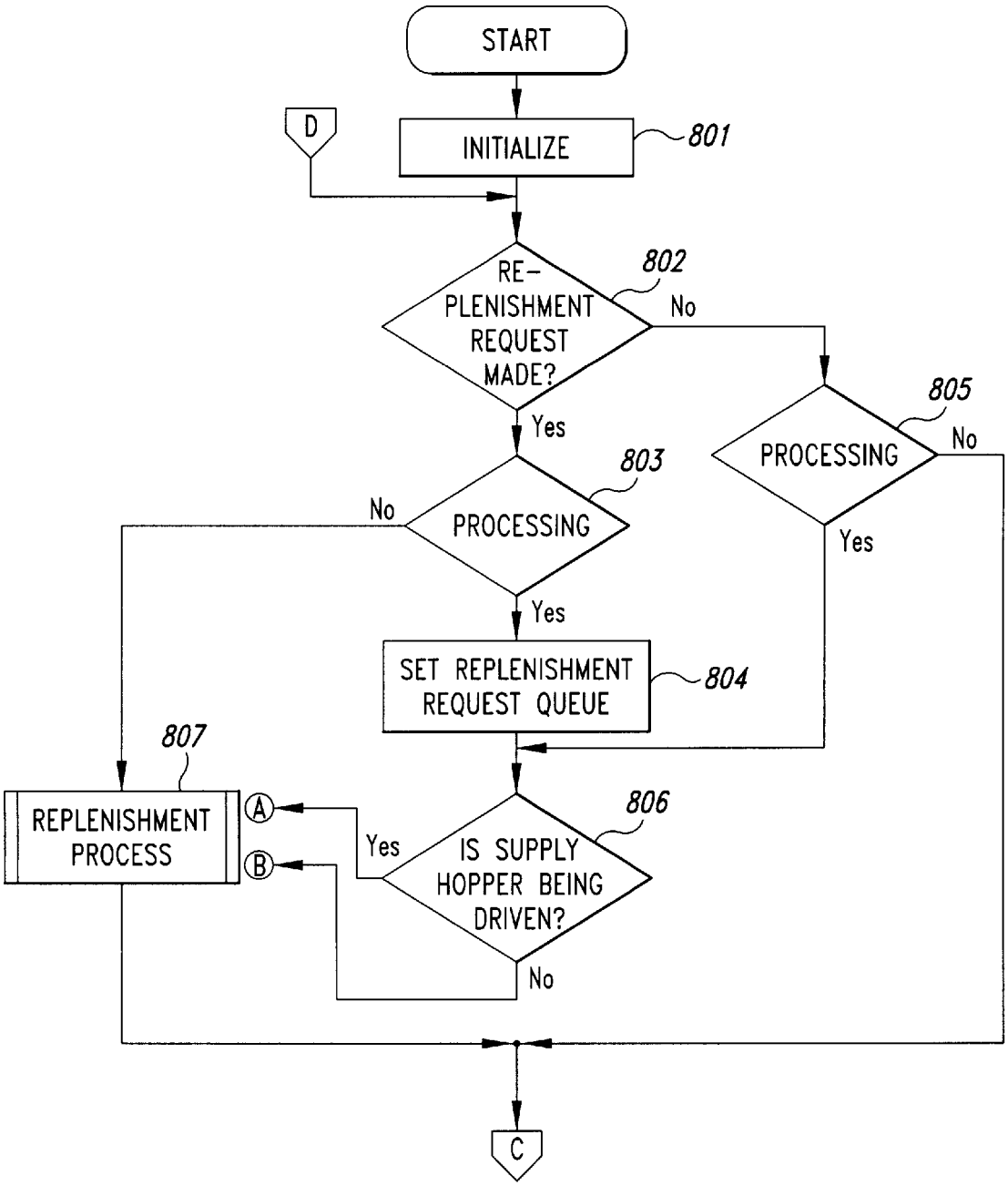
FIG. 8 is a flowchart showing an outline of a control procedure of the controller used in each embodiment of the invention.
Figure 8B:
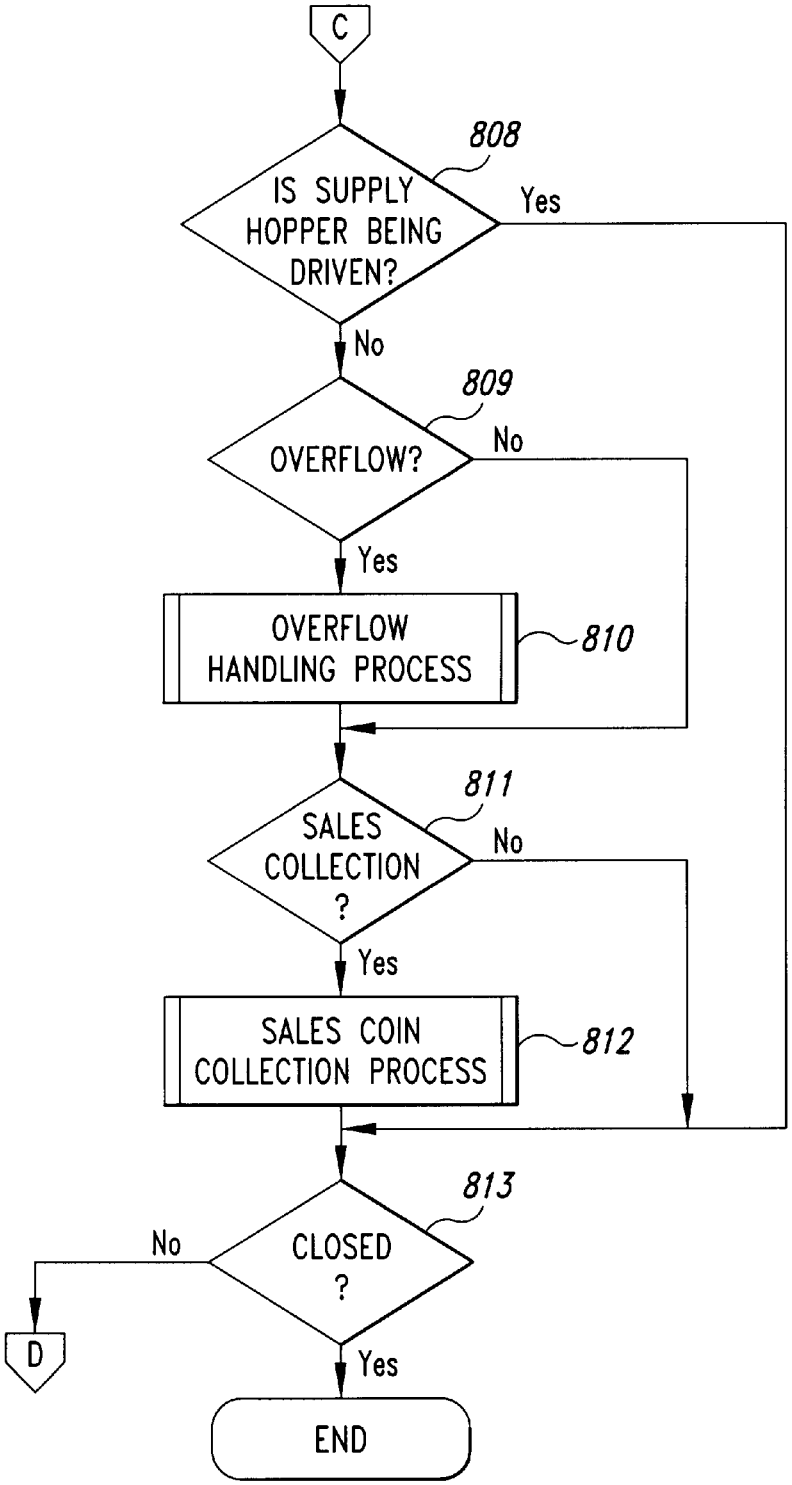

The coin branch units 250 are attached to a mounting plate 251 disposed along the replenishment conveyor 231 and a channel member 252 disposed along the mounting plate 251 for housing the replenishment conveyor 231, as shown in FIGS. 6 and 7. Specifically, each coin branch unit 250 is placed at the position of a notch 252*a* made in the channel member 252. It has a branch blocking plate 254 for closing the notch 252*a* and blocking branch of coins when coins are not made to branch, a straight-ahead blocking plate 253 for approaching the top of the conveyor and blocking travel of coins in a straight line when coins are made to branch, and a solenoid 255 for rotating the plates. The branch blocking plate 254 and the straight-ahead blocking plate 253 are supported by a common rotation shaft 255*a*.

The coin branch unit 250 has a reception part 256 on the outside of the notch 252*a* for receiving coins discharged through the notch 252*a* and a guide passage 257 following the reception part for guiding the coins into the transporter 400. The reception part 256 and the guide passage 257 are provided for each notch although only one pair is shown in FIG. 6.

Figure 5:
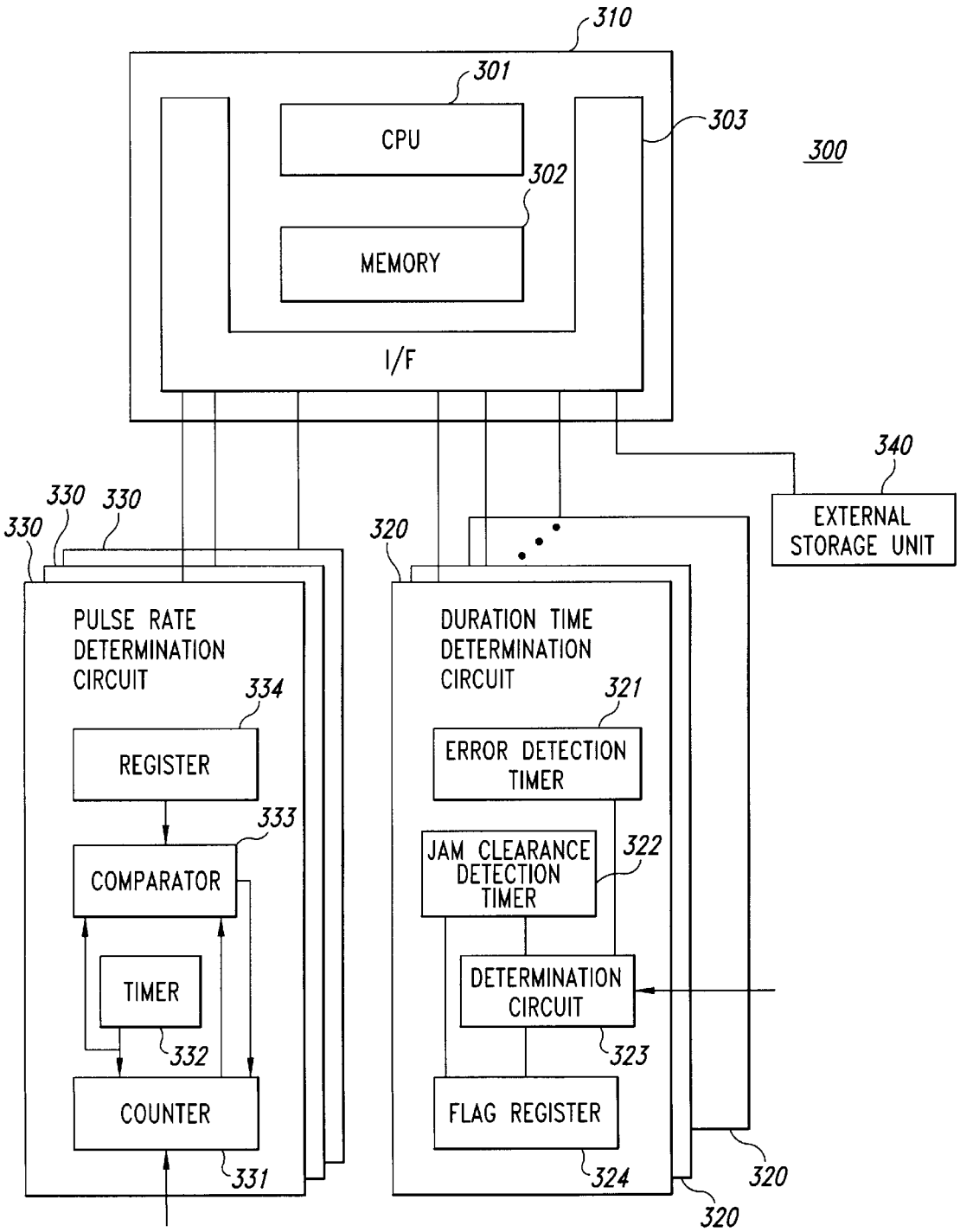
FIG. 5 is a block diagram showing the hardware system constitution of the controller used in each embodiment of the invention.

Another example of the branch unit of this kind is shown in FIG. 5 of U.S. Pat. No. 4,342,384.

The transporter 400 sends coins made to branch by the coin branch unit 250 to the dispensing hopper 130 of the slop machine, as shown in FIG. 2. For this purpose, the transporter 400 has a push-up hopper 410 and an escalator passage 420 for guiding the pushed-up coins into the dispensing hopper 130. The push-up hopper 410 is made up of a tank 411 for temporarily storing coins and a sending section 412. It sends out coins in the tank 411 using the sending section 412 in response to an instruction from the controller 300.

Another example of the push-up hopper of this kind is shown in FIG. 3 of U.S. Pat. No. 4,342,384.

The counters in the embodiment are a number-of-supplied coins counter 261 for counting the number of coins discharged from the replenishment coin supply unit 240, a number-of-collected-coins counter 262 for counting the number of coins collected at the coin collection transporter 210, separate number-of-replenished-coins counters 263 each for counting the separate number of coins replenished for dispensing coins in each coin branch unit 250, and number-of-input-coins counters 264 each for counting the number of input coins in each coin acceptor 110. The number-of-supplied-coins counter 261 is placed in the part where coins are discharged from the supply hopper 243. The number-of-collected-coins counter 262 is disposed in the part where coins are discharged from the collection conveyor 211. Each of the separate number-of-replenished-coins counters 263 is placed at the front-end of the escalator passage 420 of the transporter 400 of each slot machine 100. The number-of-input coins counters 264 are each located inside the coin acceptor 110 or in the lower part thereof.

The jam detection sensors 271–274 are placed at a position where the replenishment conveyor 231 accepts coins from the supply hopper 243, a position where coins shift from the replenishment conveyor 231 to each coin branch unit 250, a position where coins shift from the collection passage 215 to the collection conveyor 211, and a position where coins shift from the termination of the collection conveyor 211 to the coin lifter 220, respectively, for detecting a coin jam and sending a coin jam detection signal to the controller 300.

Each of the jam detection sensors 271–274 in the embodiment comprises light emitting and receiving elements placed facing each other with a coin passage between, whereby when a coin passes through, a light beam from the light emitting element is blocked and prevented from being incident on the light receiving element. Therefore, the light receiving element can sense the presence of the coin by the fact that the incident light beam is blocked. By the way, if coins move normally, the light beam blocking time is determined by the moving speed of a coin; generally it is less than one second. However, if a jam occurs, the light beam is blocked for longer than this time. Thus, a signal indicating blocking of the light beam from the light receiving element is used as a jam detection signal. In the embodiment, the controller 300 checks the duration of the jam detection signal to see if an actual jam occurs.

The motor monitor sensors 275, 276, and 277 are attached to the drive motor 232 of the replenishment conveyor 231, the drive motor 212 of the collection conveyor 211, and the drive motor 222 of the coin lifter 220 respectively for monitoring the rotation state of the corresponding motors. Each of the motor monitor sensors 275, 276, and 277 can be made of a sensor for outputting a pulse each time the corresponding motor turns by a given angle. More particularly, a disk with through holes made at every angle of given degrees is attached to a motor shaft and light emitting and receiving elements are placed facing each other with the disk between for providing each of the sensors. Thus, the light receiving element receives a light beam from the light emitting element at the position of each through hole, thereby outputting a pulse each time the motor turns by a given angle. The motors 232, 212, and 222 are turned continuously at a constant rotation speed while the gaming facility is operating. Thus, each of the motor monitor sensors 275, 276, and 277 outputs pulses of given cycles if the corresponding motor turns normally. Therefore, whether or not the number of pulses per unit time is within a predetermined range is checked, whereby a rotation error of the motor can be sensed.

The coin quantity detection sensors 281, 282, and 283 are placed in their respective target vessels for detecting the coin quantities in the vessels. That is, the sensor 281 is disposed in the coin holding vessel 241; the sensor 282 is located in the coin storage section 131 of the dispensing hopper 130; and the sensor 283 is placed in the tank main unit 501 of the spare tank 500.

Each of the sensors 281–283 detects the coin quantity as the coin storage level in the vessel rather than the number of coins. Specifically, it has a detection section consisting of a probe moving up and down and two sensing switches for sensing up and down displacements of the probe. When a small number of coins exist, the probe moves down; when a large number of coins exist, the probe moves up. The sensing switches sense whether or not up and down displacements of the probe reach predetermined upper and lower limit positions within the range of the operation strokes. Then, in the embodiment, the probe is provided with members for operating the sensing switches placed at the positions corresponding to the upper and lower limit positions. Specifically, to use microswitches as the sensing switches, the probe is provided with projections for pressing actuators of the microswitches.

The sensors 281–283 are not limited to the illustrated constitution. For example, a sensor using a lead switch and a magnet in combination, a sensor for detecting the coin quantity according to the electrostatic capacity, a sensor for detecting the coin quantity magnetically, a sensor using ultrasonic waves for detection, a sensor using light for detection, etc., can be used.

Each of the coin quantity detection sensors 281 and 282 detects shortage and sufficiency of the coin quantity. When detecting the stored coin quantity reaching a predetermined lower limit reference quantity, the sensor 281, 282 outputs a coin quantity shortage signal. When detecting the stored coin quantity reaching a predetermined upper limit reference quantity, the sensor 281, 282 outputs a coin quantity sufficiency signal. The signals are sent to the controller 300 of the coin handling mechanism 200 (see FIG. 4).

The coin quantity detection sensor 283 may be able to detect only sufficiency of the coin quantity. Therefore, a mechanism for detecting shortage of the coin quantity may be omitted.

Of course, the coin quantity detection sensor 283 may be the same as the coin quantity detection sensors 281 and 282 in constitution.

Figure 4:
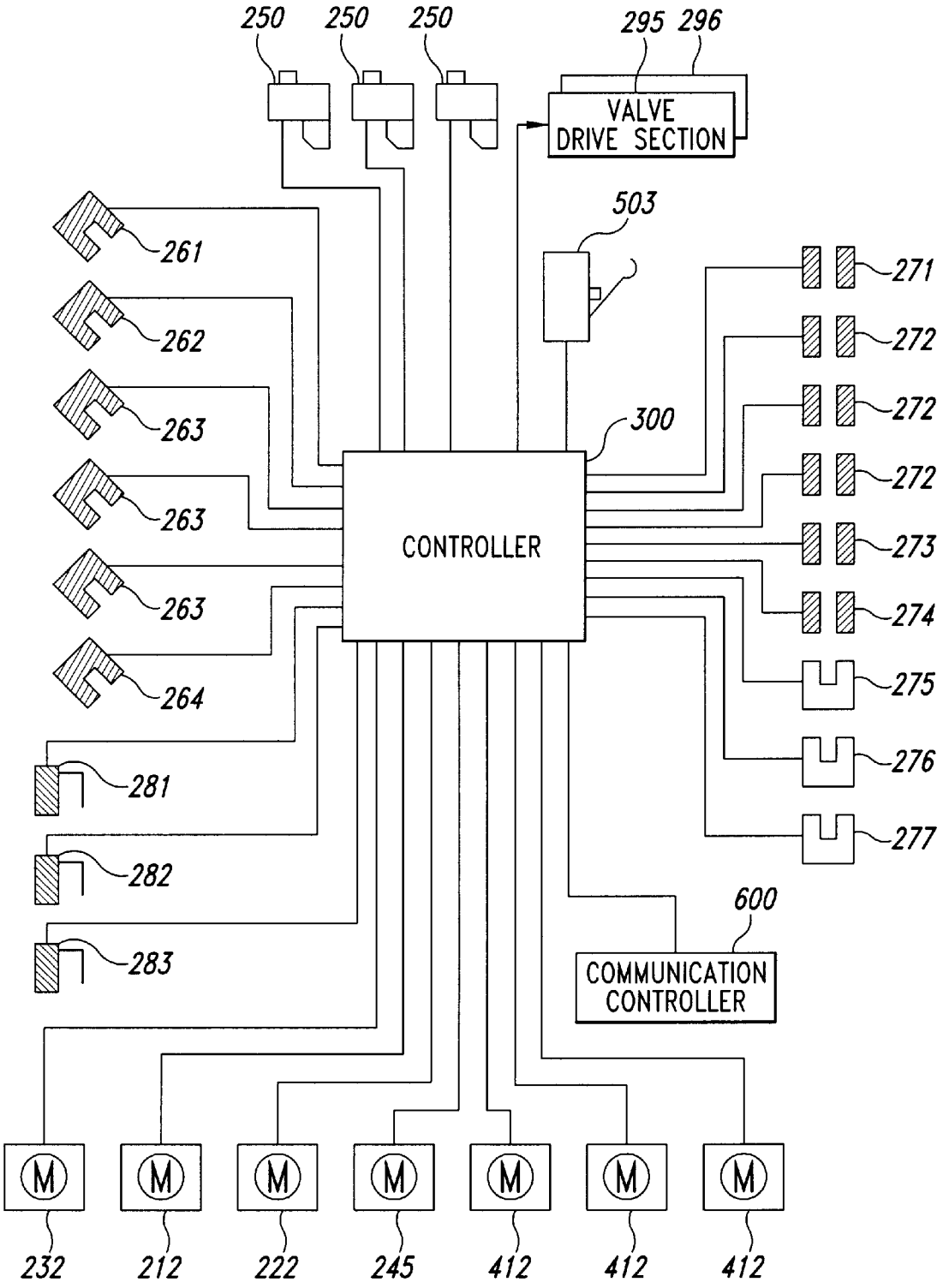
FIG. 4 is an illustration showing the connection relationships among a controller used in each embodiment of the invention, sensors for sending information to the controller, and drive sections of components controlled by the controller.

The controller 300 is connected to the number-of-coins counters 261–264, the coin quantity detection sensors 281–283, the jam detection sensors 271–273, the motor monitor sensors 275–277, and the spare tank sensing sensor 503, as shown in FIG. 4. It accepts information from the counters and the sensors and executes necessary processing accordingly. The controller 300 is also connected to the coin branch units 250, the coin sending sections 245 and 412 of the hoppers, the motor 232 of the coin replenishment transporter 230, the motor 212 of the coin collection transporter 210, the motor 222 of the coin lifter 220, and the valve drive sections 295 and 296 of the discharge direction switch 290 for controlling the operation of the members.

Further, a communication controller 600 is connected to the controller 300. The controller 300 can be connected to any other computer system via the communication controller 600 for transferring data to and from the computer system. For example, it is connected to a computer for managing all game facilities in the gaming house and information indicating start, stop, sales report, error notification, etc., is transferred between the controller and the computer.

In the embodiment, the controller 300 uses a hardware system as shown in FIG. 5, for example. That is, it comprises a processor 310 having a central processing unit (CPU) 301, a memory 302, and an interface circuit 303, an external storage unit 340, duration determination circuits 320, and pulse rate determination circuits 330. The duration determination circuits 320 are provided in a one-to-one correspondence with the jam detection sensors. The pulse rate determination circuits 330 are provided in a one-to-one correspondence with the motor monitor sensors.

The memory 302 stores programs of the CPU 301, data, etc. The processor 310 performs control in accordance with the programs stored in the memory 302. For example, programs for executing procedures shown in flowcharts of FIGS. 8, 11, 12, 13 and 14 are stored in the memory 302. For example, the data stored in the memory 302 includes a list of machines whose operation is to be stopped when a jam occurs and a list of machines whose operation is to be stopped when a motor error occurs, as shown schematically in FIGS. 9 and 10. In FIG. 9, the digits 1, 2, 3, and 4 are identical with those in FIG. 2 indicating jam points.

Each of the duration determination circuits 320 has a jam detection timer 321 started when a signal is input from the corresponding jam detection sensor 271–274, a jam clearance detection timer 322 started when the duration of the jam detection signal terminates after a jam occurs, a determination circuit 323 for comparing the duration of a specific state of an input signal with the setup time of the jam detection timer 321 and the setup time of the jam clearance detection timer 322 for determining jam occurrence and jam clearance, and a flag register 324 for setting a flag if a jam is determined to be detected, as shown in FIG. 5. The jam detection timer 321 is reset if the duration of the jam detection signal terminates before the timer times out.

In the embodiment, the jam detection timer 321 is set to two seconds and the jam clearance detection timer 322 is set to 10 seconds. Therefore, if a jam detection signal of the jam detection sensor 271, etc., namely, a signal indicating a light blocking state in the light receiving element is input and lasts for two seconds or longer, the determination circuit 323 determines that a jam has occurred. It regards the input signal as a jam detection signal detecting the jam condition and sets the flag of the flag register 324 and sends the jam detection signal, together with an interrupt request, to the interface circuit 303. The signal from the jam detection sensor can be set at a high level when indicating the light blocking state in the light receiving element and at a low level when indicating the light-passing state, for example.

On the other hand, if the signal indicating the light blocking state in the light receiving element is turned off, namely, it changes to a signal indicating the light-passing state, the jam clearance detection timer 322 is started. If the signal indicating the light-passing state lasts for 10 seconds or longer, the determination circuit 323 determines that the jam is cleared, and resets the flag register 324, whereby sending of the jam detection signal to the interface circuit 303 is stopped.

The reasons why such steps are taken are as follows: For the first reason, if a jam occurs, it may be cleared naturally by the effect of vibration, etc. For the second reason, if the stopped machines are operated immediately when the jam is cleared, some of the coins causing the jam and new supplied coins will easily cause another jam to occur, and so steps are taken to avoid this type of accident.

Each of the pulse rate determination circuits 330 has a timer 332 for outputting a time-out signal every given time, a counter 331 for counting pulses from the motor monitor sensor and stopping the counting in response to the time-out signal from the timer 332, a register 334 for previously storing the upper and lower limit values of the number of pulses per unit time (pulse rate), and a comparator 333 for taking in the count of the counter 331 stopping the counting when the time-out signal of the timer is output and comparing the count with the upper and lower limit values stored in the register 334 for determining whether or not the pulse rate is in the normal range. When determining that an error occurs, the determination circuit 330 sends an error occurrence signal together with an interrupt signal to the interface circuit 303.

The duration determination circuits 320 and the pulse rate determination circuits 330 can also be provided by software in the processor 310.

The CPU 301 of the processor 310 executes processes in accordance with flowcharts of FIGS. 8, 11, 12, 13, and 14. In the embodiment, the following processes are executed (a) A coin replenishment process being responsive to a replenishment request from each slot machine for replenishing the requesting slot machine with coins (steps 802–808). This process is mainly executed by branch control means, coin supply control means, switch control means, and duplicate replenishment process inhibition means.

(b) An overflow handling process of the coin holding vessel 241 (steps 809 and 810). This handling process is executed by coin supply control means, switch control means, and number-of-coins management means.

(c) A sales coin collection process (steps 811 and 812). This process is executed by coin supply control means, switch control means, and number-of-coins management means, like the overflow handling process.

In the embodiment, a jam countermeasure process and a motor error countermeasure process (see FIG. 12) are executed. To execute the processes, an interrupt is generated each time an interrupt request for executing the process is input from any of the duration determination circuits 320 or any of the pulse rate determination circuits 330. In the embodiments, the processes are executed by jam countermeasure process means containing the duration determination circuits 320, and motor error countermeasure process means containing the pulse rate determination circuits 330.

First, before the gaming facility of the embodiment is started, the coin holding vessel 241 is replenished with coins. Coins are input in such a quantity that about 5000 coins, for example, are held in the coin holding vessel 241 and the supply hopper 243. The number of replenished coins at this time is previously counted.

In this state, the power of the gaming facility is turned on. The slot machine controllers 125 in the slot machines 100-1, 100-2, and 100-3 execute initialization accordingly. In the coin handling mechanism 200, the processor 310 executes initialization at step 801. If the dispensing hopper 130 in the slot machine has an insufficient amount of coins, the coin quantity detection sensor 282 senses the event and sends a coin quantity shortage detection signal to the processor 310.

The game execution operation in the slot machine is generally known and therefore will not be discussed here. Therefore, we will provide a description centering on processing in the coin handling mechanism 200. In the description to follow, it is assumed that a measure of time has elapsed since the gaming facility was started.

Next, the CPU 301 checks whether or not a signal indicating coin shortage is output from the coin quantity detection sensor 282 for any slot machine 100 at step 802. That is, if a coin shortage signal is input to the interface circuit 303, the CPU 301 determines that a replenishment request is made. Further, the CPU 301 checks whether or not a replenishment process is being executed at present at step 803 according to a flag set in a flag area located in the memory 302. The flag register contained in the CPU 301 may be used to set the flag. If a replenishment process is not being executed, it is executed at step 807, as described later. If a replenishment process is being executed, a replenishment request queue is set at step 804. Information specifying the slot machine making the replenishment request is read from the interface circuit 303 and is stored in the replenishment request queue. If two or more replenishment requests contend with each other, they are listed in the request order.

Thus, in the embodiment, if any coin branch unit 250 operates, a replenishment request queue is set in the memory 302 and another replenishment process is made to wait for execution until the preceding replenishment operation is complete, thereby inhibiting a duplicate replenishment process, whereby contention among replenishment processes responsive to replenishment requests issued from a plurality of slot machines can be avoided and replenishment coins required by each slot machine can be reliably sent to the corresponding slot machine. If such inhibition is not executed, there is a possibility that a problem will occur wherein a later replenishment request is handled while the preceding one is being handled, and coins to be sent to the slot machine making the preceding request are sent to the slot machine making the later request.

Next, the CPU 301 checks whether or not the supply hopper 243 is being operated at step 806 by checking to see if a supply hopper operation flag is set in a similar manner to that described above. If the supply hopper 243 is being operated, control goes to point A of the replenishment process shown in FIG. 11 (described later). On the other hand, if the supply hopper 243 is not being operated, control goes to point B of replenishment process shown in FIG. 11.

If a replenishment process is being executed at step 805, control goes to step 806. On the other hand, if a replenishment process is not being executed, it means that a replenishment process is not executed and a replenishment request is not made either. Thus, control goes to the following step.

Next, the CPU 301 checks whether or not the supply hopper 243 is being operated at step 808 by checking to see if the supply hopper operation flag is set as described above. If the supply hopper 243 is being operated, steps 809 to 812 are skipped. On the other hand, if the supply hopper 243 is not being operated, control shifts to an overflow handling process.

First, the CPU 301 checks whether or not there is a danger of the coin holding vessel 241 overflowing at step 809. If a sufficiency signal is output from the coin quantity detection sensor 281, it is determined that there is a danger of the coin holding vessel 241 overflowing. In this case, an overflow handling process (described later) is executed at step 810. The overflow means that excessive coins are stored in the coin holding vessel 241 exceeding a predetermined upper limit reference quantity. Overflowing coins are as many stored coins that exceed the upper limit reference quantity.

After the overflow handling process is complete, or if the overflow handling process is not required, whether or not a request for collecting sales coins is made is determined at step 811. If it is made, a sales coins collection process (described later) is executed at step 812.

After the process is complete or if the process is not executed, whether or not the gaming house is to be closed is determined. If the gaming house is not yet closed, control returns to step 802. To determine whether or not the gaming house is to be closed, whether or not a closing command exists is checked. This command is input, for example, from an external system via the communication controller 600, through a switch (not shown), etc.

Figure 11:
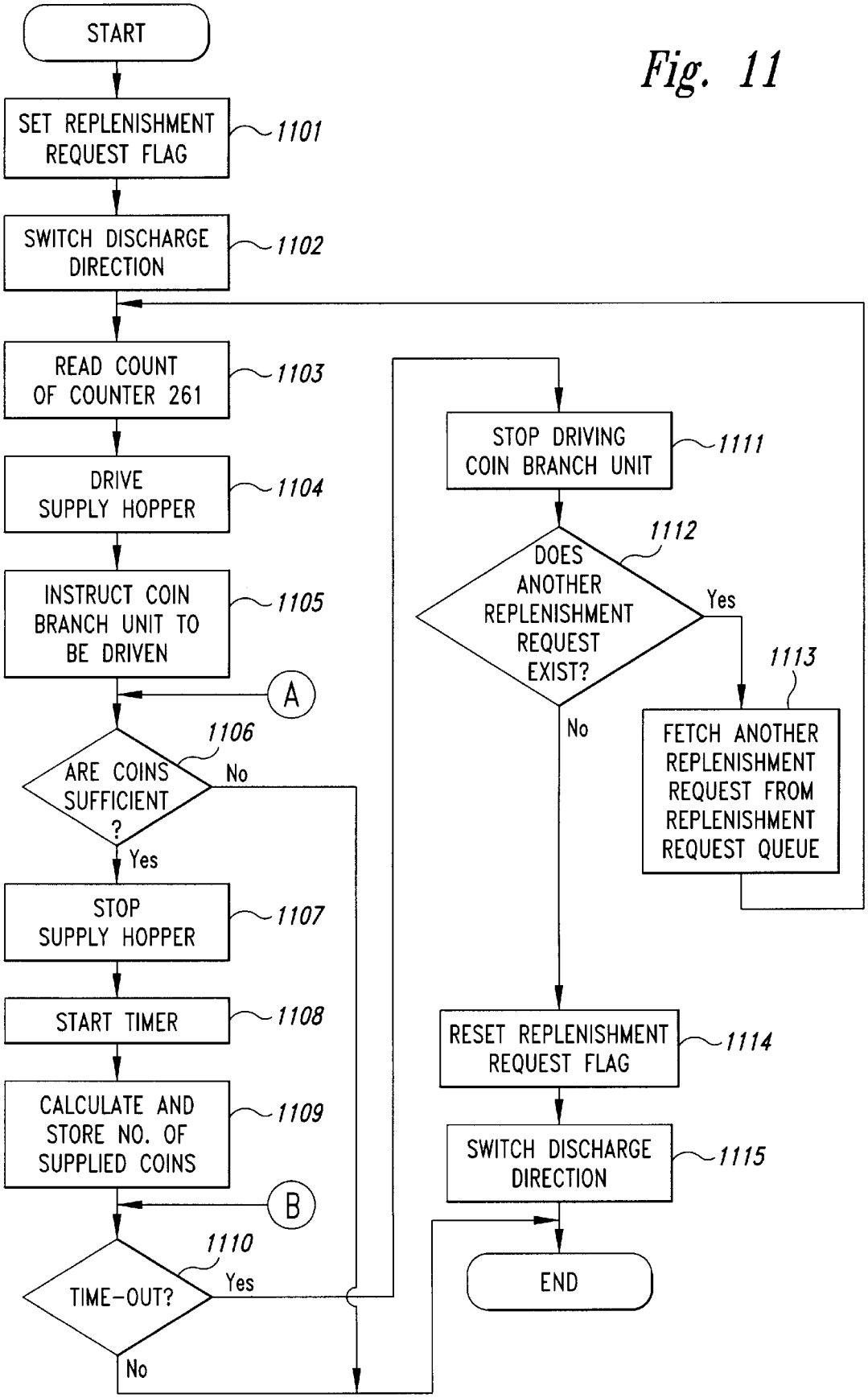
FIG. 11 is a flowchart showing a replenishment procedure in the first embodiment of the invention.
Figure 12:
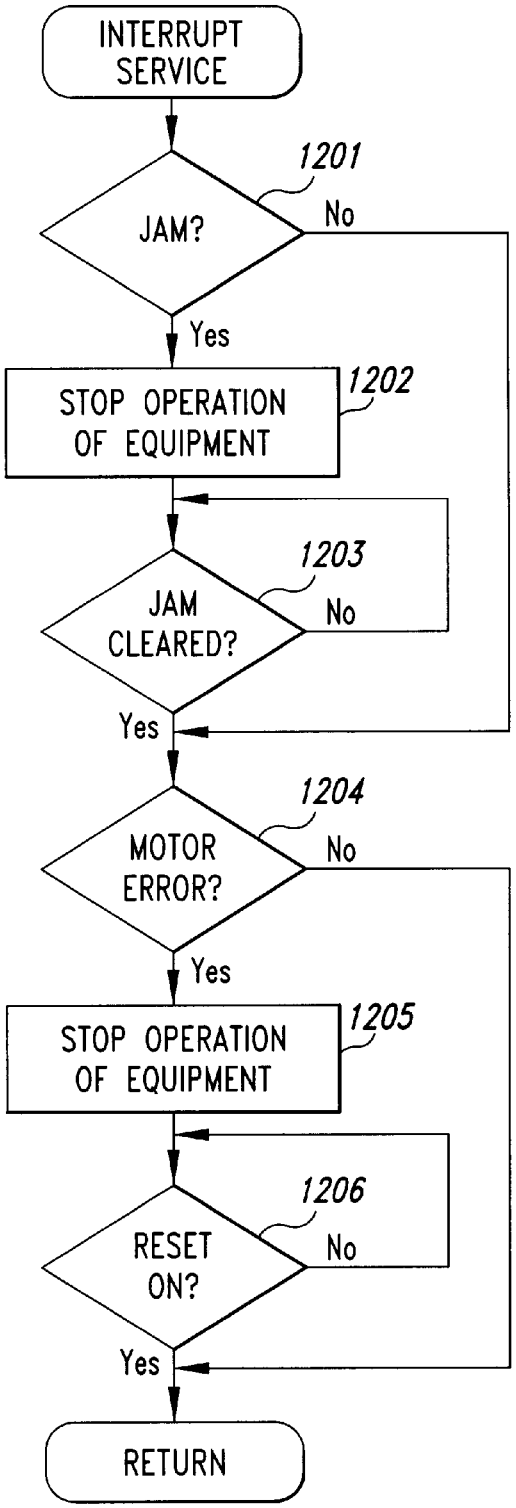
FIG. 12 is a flowchart showing a jam and motor error handling procedure in each embodiment of the invention.

Next, the replenishment process will be discussed in detail with reference to FIG. 11.

The CPU 301 first sets the replenishment request flag in the flag setting area of the memory 302 at step 1101. The flag register contained in the CPU 301 may be used for the flag. At this time, information to specify the slot machine issuing the replenishment request is stored in a specific area of the memory 302.

Next, the CPU 301 instructs the valve drive section 295 of the discharge direction switch 290 to open the valve 291 at step 1102. It reads the current value of the number-of-supplied-coins counter 261 and stores the value in a number-of-supplied-coins counter value storage area of the memory 302 at step 1103. The CPU 301 instructs the sending section 245 of the supply hopper 243 to discharge coins at step 1104. Further, it references the information to specify the slot machine stored in the specific area of the memory 302 and instructs the coin branch unit 250 corresponding to the slot machine specified by the information to make coins branch from the replenishment conveyor 231 into the slot machine at step 1105. Then, the supply hopper 243 sends out coins in sequence via the passage 293 of the discharge direction switch 290. The sent-out coins are placed on the replenishment conveyor 231 and are transported thereon. The supply hopper 243 can also be used to send out coins intermittently rather than continuously.

The CPU 301 checks whether or not the coin quantity detection sensor 282 installed in the dispensing hopper 130 of the slot machine outputs a signal indicating sufficiency at step 1106. If the signal is not output, steps 1107–1115 are skipped and control shifts to step 808 in FIG. 8, then again enters step 1106 in FIG. 11 through step 813, steps 802–806. This process is executed until the slot machine is replenished with sufficient coins.

When the slot machine is replenished with sufficient coins, the CPU 301 outputs an instruction for stopping drive of the supply hopper at step 1107, thereby stopping the supply hopper 243 supplying coins. The CPU 301 starts a timer at step 1108. This timer is constituted in software in the embodiment. However, a hardware timer may be used.

Further, the CPU 301 calculates the number of supplied coins and finds the total number of supplied coins based on the calculated number, then stores the total number in a total number-of-supplied-coins storage area of the memory 302 at step 1109. That is, it reads the count of the number-of-supplied-coins counter 261 and finds a difference between the read count and the count just before the supply started, stored in the number-of-supplied-coins counter value storage area of the memory 302 for calculating the number of supplied coins this time. Further, the CPU 301 adds the number of supplied coins this time to the total number of supplied coins counted so far, stored in the total-number-of-supplied-coins storage area of the memory 302, for finding the cumulative total number of supplied coins, and replaces the total number of supplied coins stored in the total-number-of-supplied-coins storage area of the memory 302 with the found cumulative total number of supplied coins. In the embodiment, the number of supplied coins is managed as the sum total of supplied coins for all slot machines, but may be managed for each slot machine.

Next, the CPU 301 checks whether or not the started timer times out at step 1110. If the timer does not yet time out, the following steps 1111–1115 are skipped and control goes to step 808 in FIG. 8. In this case, the supply hopper 243 is not driven, thus steps 809–813 are executed. Since the process is not complete, control returns to step 802 and goes to step 1110 in FIG. 11 through steps 802–806. This process loop is executed until the timer times out.

When the timer times out, the CPU 301 stops driving the corresponding coin branch unit 250 at step 1111. That is, the mechanism of the coin branch unit 250 for making coins branch is located away from the replenishment conveyor 231 for transporting coins on the replenishment conveyor 231 without branch, whereby the duplicate replenishment process inhibition is released. The purpose for taking such steps is to reliably replenish the slot machine making the replenishment request with all coins discharged from the supply hopper 243.

The time-out time of the timer is determined by the time required for transporting coins. However, the time required for transporting coins varies from one slot machine to another, and thus the time-out time is set separately for each slot machine. In the embodiment, however, to simplify the constitution, the time common to all slot machines is set based on the time required for transporting coins to the slot machine at the position most distant from the supply hopper 243.

Next, the CPU 301 checks the replenishment request queue to determine whether or not another replenishment request exists at step 1112. If another replenishment request exists, it is fetched from the replenishment request queue at step 1113. The steps following step 1103 are repeated.

On the other hand, if no replenishment request remains, the replenishment request flag is reset at step 1114. Then, the CPU instructs the valve drive section 295 of the discharge direction switch 290 to close the valve 291 at step 1115. The valve may be closed at the beginning of the next process.

In the embodiment, the valves are provided in a one-to-one correspondence with the passages 293 and 294, but one valve may be used to switch the passages.

Assuming that a problem such as a jam or a motor error occurs in any part of the coin handling mechanism, handling the problem will be discussed.

When an interrupt request is made, the CPU 301 saves the current process and executes an interrupt service. Next, it checks whether or not a jam detection signal exists at step 1201. That is, the CPU 301 checks whether or not a jam detection signal from the duration determination circuit 320 is sent to the interface circuit 303. If the jam detection signal is input from any jam detection sensor at the high level, a jam countermeasure process is executed.

The CPU 301 first checks the input port of the interface circuit 303 to which the jam detection signal is input at the high level, to previously sense the corresponding jam detection sensor. Next, it looks up in the stop machine list prestored in the memory 302 (see FIG. 9), reads the information indicating the machines to be stopped, and instructs the machines to stop the operation at step 1202. For example, if a jam occurs at the point 1 in FIG. 2 and the jam detection signal is sent from the jam detection sensor 271, the CPU 301 stops driving the sending section 245 of the supply hopper 243. If a jam occurs at the point 2 in FIG. 2, the CPU 301 stops driving the sending section 245 of the supply hopper 243 and the corresponding coin branch unit 250. If a jam occurs at the point 3 in FIG. 2, the CPU 301 stops driving the sending section 245 of the supply hopper 243 and the motor 232 of the replenishment conveyor 231. Further, if a jam occurs at the point 4 in FIG. 2, the CPU 301 stops driving the sending section 245 of the supply hopper 243, the motor 232 of the replenishment conveyor 231, and the motor 212 of the collection conveyor 211.

Thus, in the embodiment, attention is focused on the flow of coins so that driving of equipment, placed upstream from the jam occurrence point, for supplying or moving coins is stopped, thereby preventing the number of coins involved in the jam from increasing. If the number of coins involved in the jam does not increase, natural clearance of the jam because of vibration, etc., can be expected. If the number of coins involved in the jam is small, coins can be prevented from overflowing the jam point.

The CPU 301 outputs an alarm signal for notifying jam occurrence in addition to stopping driving of the machines. This alarm signal is sent to an alarm unit 900 disposed in the coin handling mechanism 200 for giving an alarm. The alarm unit 900 produces sound and/or flashes light, for example. The alarm signal is sent through the communication controller 600 to a control room, etc., for operating an alarm unit (not shown) located in the control room.

If the jam is naturally cleared, the CPU 301 stops sending the alarm signal. If the jam is not naturally cleared, a worker in the gaming house clears the jam at the jam point. Then, when the worker presses a reset switch (not shown), the CPU 301 judges that the jam has been cleared, stops the alarm, and recovers the process at step 1203.

After the jam clearance process is executed or if no jam occurs, the CPU 301 checks whether or not a motor error detection signal exists at step 1204. That is, it checks whether or not a motor error detection signal from the pulse rate determination circuit 330 is sent to the interface circuit 303. If the motor error detection signal is input from any motor monitor sensor at the high level, a motor error countermeasure process is executed.

The CPU 301 first checks the input port of the interface circuit 303 to which the motor error detection signal is input at the high level for sensing the previously corresponding motor monitor sensor. Next, it looks up in the stop equipment list prestored in the memory 302 (see FIG. 10), extracts the information indicating the equipment to be stopped, and instructs the machines to stop the operation at step 1205. For example, if an error occurs in the motor 232 of the replenishment conveyor 231 and the motor error detection signal is sent from the motor monitor sensor 275, the CPU 301 stops driving the sending section 245 of the supply hopper 243 and the motor 232 of the replenishment conveyor 231. If an error occurs in the motor 212 of the collection conveyor 211, the CPU 301 stops driving the sending section 245 of the supply hopper 243, the motor 232 of the replenishment conveyor 231, and the motor 212 of the collection conveyor 211. Further, if an error occurs in the motor 222 of the coin lifer 220, the CPU 301 stops driving the sending section 245 of the supply hopper 243, the motor 232 of the replenishment conveyor 231, the motor 212 of the collection conveyor 211, and the motor 222 of the coin lifter 220.

Thus, in the embodiment, attention is focused on a flow of coins so that driving of equipment, placed upstream from the motor error occurrence point, for supplying or moving coins is stopped, thereby preventing coins from being concentrated on the entrance of the motor error occurrence point. A jam caused by concentration of coins is thus prevented.

The CPU 301 resets the alarm and the operation stop at step 1206 after recovery from the motor error as in the above-described jam detection. The motor error can also be cleared naturally. In this case, the alarm and the operation stop are also reset.

By the way, the fact that the error occurred, the error point, and the time of the error occurrence are stored in a recording area previously provided in the memory 302. This is also performed for the above-described jam detection in a similar manner.

Figure 13:
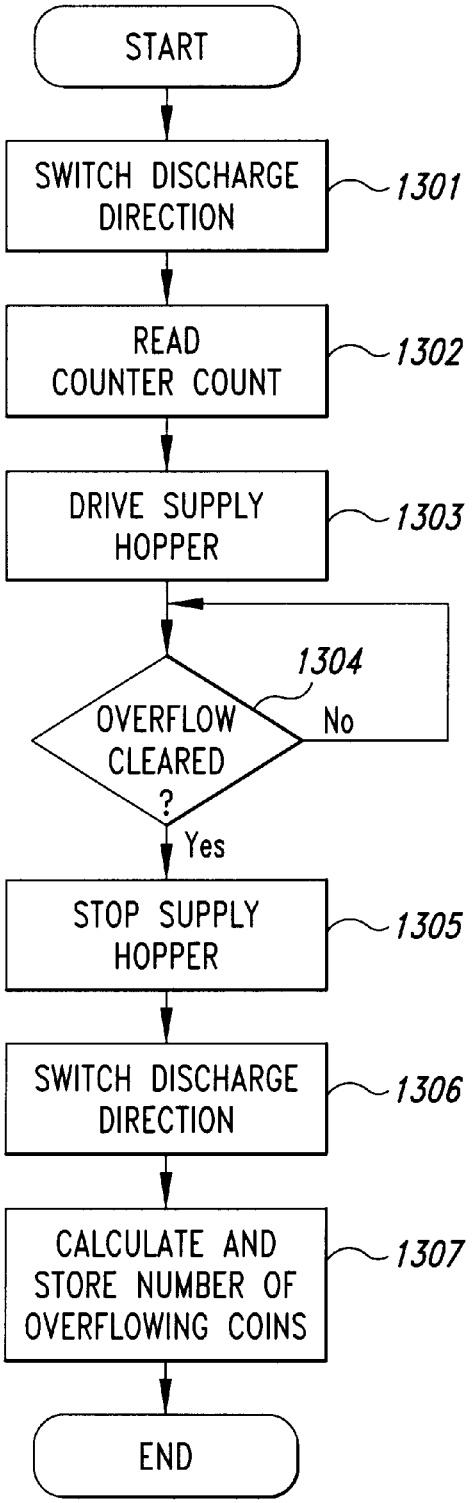
FIG. 13 is a flowchart showing an overflow handling procedure in a coin holding vessel used in each embodiment of the invention.

Next, the overflow process will be discussed in detail with reference to FIG. 13.

When a coin sufficiency signal is input from the coin quantity detection sensor 281 located in the coin holding vessel 241, the CPU 301 executes an overflow handling process. Preferably, the coin sufficiency signal is output when coins reach less than 100% of the capacity of the coin holding vessel 241 to provide a margin for the remaining capacity, rather than when coins reach 100% of the capacity of the coin holding vessel 241. The percentage is determined by change in the coin demand quantity in the gaming facility. For example, it is set to about 90% of the capacity of the coin holding vessel 241.

First, the CPU 301 instructs the valve drive section 296 of the discharge direction switch 290 to open the valve 292 at step 1301. It reads the count of the number-of-supplied-coins counter 261 and stores the count in the number-of-supplied-coins counter value storage area of the memory 302 at step 1302. The CPU 301 drives the supply hopper 243 at step 1303. In this state, coins are sent from the supply hopper 243 via the passage 294 to the tank main unit 501 of the spare tank 500. The CPU 301 monitors the coin sufficiency signal from the coin quantity detection sensor 281 and remains in this state until the signal disappears at step 1304. It may judge the overflow to be cleared after the expiration of a predetermined time interval since the coin sufficiency signal disappeared.

Next, the CPU 301 stops driving the supply hopper 243 at step 1305. It instructs the valve drive section 296 of the discharge direction switch 290 to close the valve 292 at step 1306. The CPU 301 reads the count of the number-of-supplied-coins counter 261 and calculates the number of coins sent to the spare tank 500 from the count and the count stored in the number-of-supplied-coins counter value storage area of the memory 302. The calculated number of coins is stored in a number-of-overflowing-coins storage area of the memory 302 as the number of overflowing coins at step 1307.

Then, the supply of the coins to the spare tank 500 is stopped and the overflow handling process is complete.

Figure 14:
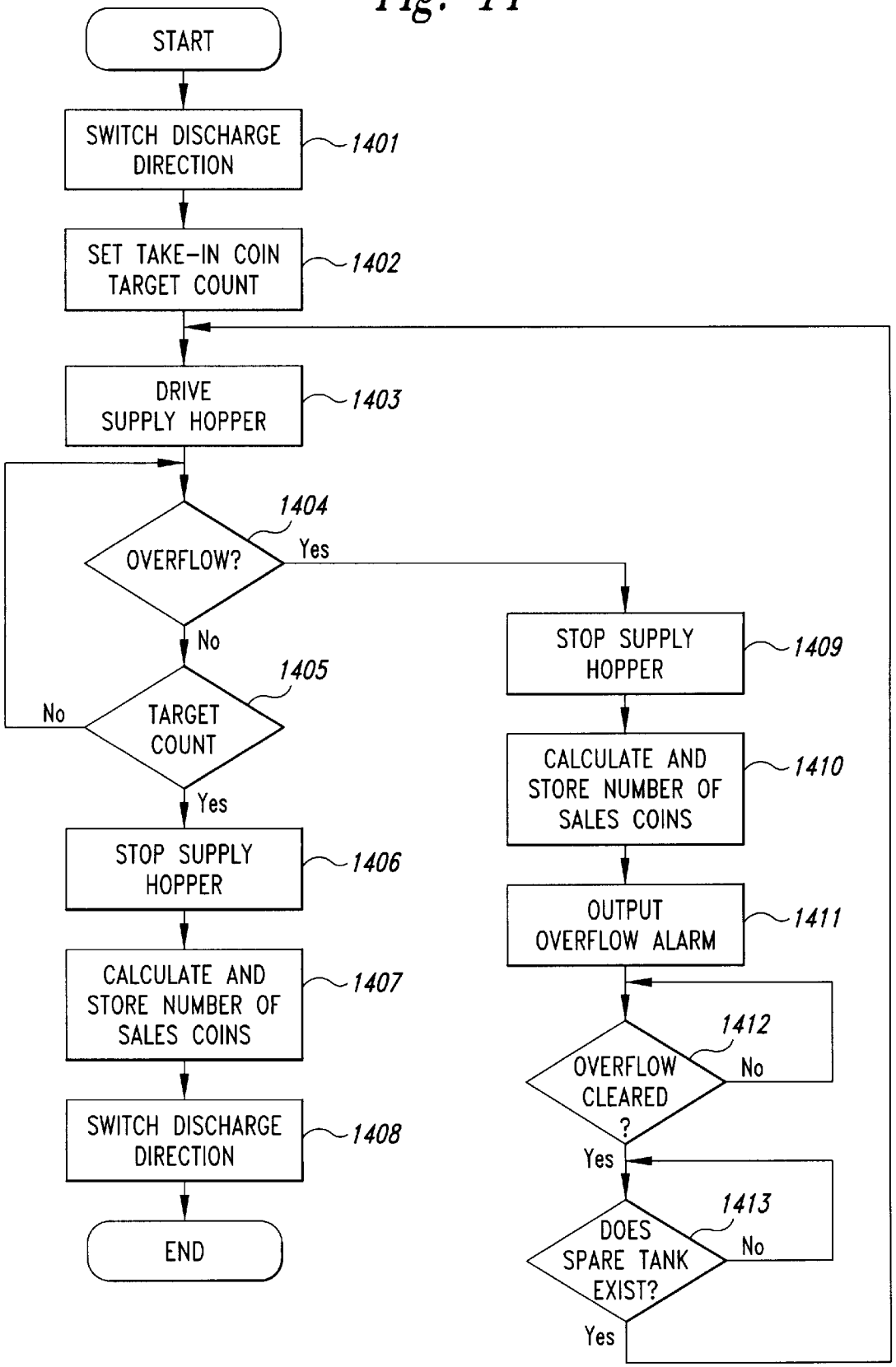
FIG. 14 is a flowchart showing a sales coins collection procedure.

Next, a sales coin collection process will be discussed in detail with reference to FIG. 14.

The CPU 301 executes a sales coin collection process when a sales coin collection instruction is given through a switch (not shown) or from a host computer system through the communication controller 600.

First, the CPU 301 instructs the valve drive section 296 of the discharge direction switch 290 to open the valve 292 at step 1401. It sets a take-in coin target count at step 1402. For example, the target count is set as follows: First, the CPU 301 reads the count of the number-of-supplied-coins counter 261 and the count of the number-of-collected-coins counter 262 and stores the counts in the number-of-supplied-coins counter value storage area and the number-of-collected-coins counter value storage area, respectively, of the memory 302. It also reads the number of overflowing coins from the-number-of-overflowing-coins storage area of the memory 302 and subtracts the number of overflowing coins from the number of coins to be collected as sales, stored in the number-of-collected-coins counter value storage area, to calculate the balance number of collected coins. Then, the CPU 301 adds the balance number of collected coins to the count of the number-of-supplied-coins counter 261 for calculating the taken-in coin target count, and stores the calculated target count in a taken-in coin target count storage area of the memory 302.

Next, the CPU 301 drives the supply hopper 243 at step 1403. In this state, coins are sent from the supply hopper 243 via the passage 294 to the tank main unit 501 of the spare tank 500. The CPU 301 checks whether or not a coin sufficiency signal is output from the coin quantity detection sensor 283 disposed in the spare tank 500 at step 1404.

If no overflow occurs, the CPU 301 reads the count of the number-of-supplied-coins counter and compares the count with the taken-in coin target count stored in the taken-in coin target count storage area of the memory 302. If the count does not reach the target count, control returns to step 1404 and this state is maintained until an overflow occurs or the number of taken-in coins reaches the target count at step 1405.

Here, when inputting a coin sufficiency signal from the coin quantity detection sensor 283, the CPU 301 stops the operation of the supply hopper 243 at step 1409. It reads the count of the number-of-supplied-coins counter 261, finds a difference between the count and the count just before the collection, stored in the number-of-supplied-coins counter value storage area of the memory 302, and adds the number of overflowing coins to the difference to calculate the number of sales coins stored in the spare tank, then stores the number of sales coins in the-number-of-sales-coins storage area of the memory 302 together with a code for identifying the spare tank at step 1410. The count of the number-of-supplied-coins counter 261 read at this point in time is stored in the number-of-supplied-coins counter value storage area after the calculation is made.

Next, the CPU 301 outputs an overflow occurrence alarm at step 1411. This alarm output is sent to the alarm unit 900 and the host computer system, for notifying of overflow occurrence. In this state, the CPU 301 monitors the coin sufficiency signal from the coin quantity detection sensor 283 and remains in this state until the signal disappears at step 1412. If the overflow is cleared, the CPU 301 checks output of the tank detection sensor 503 to determine whether or not a new spare tank exists at step 1413. If a tank is set, control returns to step 1403 at which the supply hopper is driven and coin collection is restarted.

If an overflow occurs, it is handled in the same manner as described above. Last, if the count of the number-of-supplied-coins counter 261 reaches the taken-in coin target count, the CPU 301 stops the supply hopper 243 at step 1406.

Further, the CPU 301 subtracts the count stored in the number-of-supplied-coins counter value storage area from the current count of the number-of-supplied-coins counter 261 for calculating the number of sales coins stored in the spare tank 500 and stores the calculated number of sales coins in the-number-of-sales-coins storage area of the memory 302 together with the code for identifying the spare tank at step 1407. If the spare tank stores overflowing coins, that is, if steps 1409–1413 are skipped, the number of overflowing coins is added, as at step 1410.

The CPU 301 instructs the valve drive section 296 of the discharge direction switch 290 to close the valve 292 at step 1408. The sales coin collection process is now complete.

In each process described above, the number of coins is calculated and stored as a function of the number-of-coins management means. This function may be collected within one module.

The number-of-coins management means cumulatively adds the number of supplied coins, stored at the time of coin replenishment for finding the number of coins with which the slot machine is replenished, whereby the number of replenished coins can be known.

In the embodiment, coin replenishment from the supply hopper 243 to the replenishment conveyor 231 is stopped upon receipt of a coin sufficiency signal from the coin quantity detection sensor 282. However, the invention is not thus limited. For example, while a given number of coins are counted, they may be supplied from the supply hopper.

Next, a second embodiment of the invention will be discussed. The embodiment is intended for supplying coins while counting a given number of coins from the supply hopper. It is the same as the first embodiment except for a part of the coin replenishment process. Therefore, we will provide a description centering on the coin replenishment process.

FIG. 15 shows an example of a procedure of the coin replenishment process of the embodiment. Steps 1501, 1502, and 1507 and later shown in FIG. 15 are the same as steps 1101, 1102, and 1107 and later shown in FIG. 11. Therefore, for the description of the steps in FIG. 15, see the description of the corresponding steps in FIG. 11.

Next, after executing steps 1501 and 1502, a CPU 301 reads the current value of a number-of-supplied-coins counter 261 and adds a predetermined number of replenishment coins to the value for calculating a supplied coin target count at step 1503. This supplied coin target count is temporarily stored in a memory 302 until supply of coins responsive to the current coin replenishment request is complete.

Next, the CPU 301 instructs a sending section 245 of a supply hopper 243 to discharge coins at step 1504. Further, it references information to specify the corresponding slot machine stored in a specific area of the memory 302 and instructs a coin branch unit 250 corresponding to the slot machine specified by the information to make coins branch from a replenishment conveyor 231 into the slot machine at step 1505. Then, the supply hopper 243 sends out coins in sequence via a passage 293 of a discharge direction switch 290. The sent-out coins are placed on the replenishment conveyor 231 and are transported thereon. The supply hopper 243 can also be used to send out coins intermittently rather than continuously.

The CPU 301 reads the count of a number-of-supplied-coins counter 261 and compares the count with the supplied coin target count stored in the memory 302 to check whether or not the count of the counter reaches the target count at step 1506. If the count does not reach the target count, steps 1507–1515 are skipped and control shifts to step 808 in FIG. 8. Step 1506 in FIG. 15 is then entered again through step 813 and steps 802–806. This loop process is executed until the count reaches the target value.

If the count reaches the target value, the CPU 301 outputs an instruction for stopping drive of the supply hopper 243 at step 1507, thereby stopping the supply hopper 243 supplying coins. The subsequent steps are the same as those previously described with reference to FIG. 11.

Next, a third embodiment of the invention will be discussed with reference to the accompanying drawings. The embodiment is the same as the first and second embodiments except that a coin dispenser in a slot machine differs from that shown in FIG. 2 in constitution. Therefore, we will provide a description centering on the difference therebetween.

Figure 16:
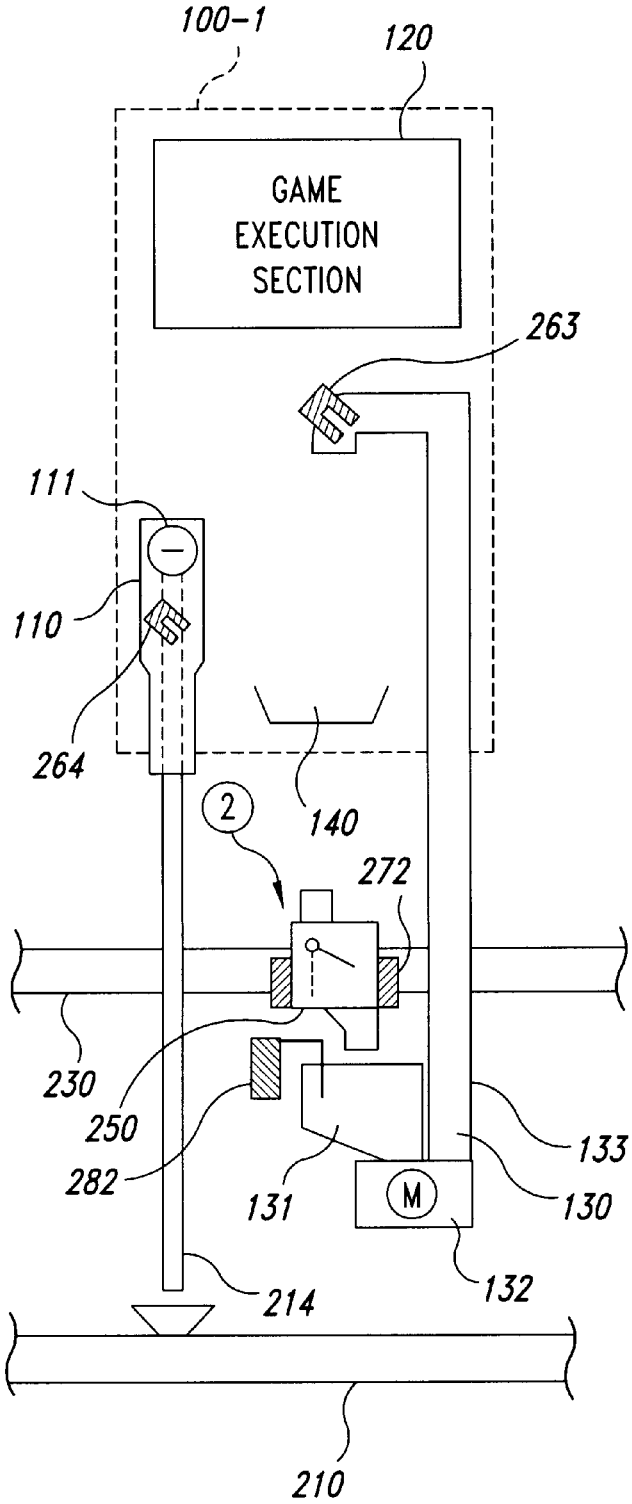
FIG. 16 is an illustration showing the constitution of a slot machine used with a third embodiment of the invention.

FIG. 16 shows one slot machine, one coin branch unit, a part of a replenishment conveyor, and a part of a collection conveyor in the third embodiment of the invention. Like the first embodiment shown in FIG. 2, the third embodiment has a number of slot machines and a coin handling mechanism for replenishing the slot machines with coins and collecting coins therefrom although they are not shown. Therefore, the embodiment results from replacing each slot machine in the gaming facility shown in FIG. 2 with the slot machine shown in FIG. 16. Therefore, see FIG. 2 for components other than the slot machines.

The slot machine shown in FIG. 16 has a coin acceptor 110, a game execution section 120, and a coin dispenser 130.

In the embodiment, the coin dispenser 130 has a coin storage section 131, a coin sending section 132, and an escalator passage 133 for guiding coins sent out from the coin sending section 132 into a coin return. The coin storage section 131 and the coin sending section 132 are placed below a coin branch unit 250.

A coin quantity detection sensor 282 is attached to the coin storage section 131 like that shown in FIG. 2. The sensor outputs signals indicating coin shortage and sufficiency.

A separate number-of-replenished-coins counter 263 is disposed at the front-end of the escalator passage 133. In the embodiment, the counter 263 counts the number of coins with which the corresponding slot machine is replenished as the number of dispensed coins, namely, it functions as a number-of-dispensed-coins counter.

In the embodiment, a coin replenishment request and a replenishment stop request are made according to the coin quantity detection sensor 282.

The embodiment can also adopt a coin replenishment method similar to that adopted in the second embodiment.

Since a transporter for transporting coins is omitted between the coin branch unit and the coin dispenser in the embodiment, the constitution is simple and the number of parts is also small, so that the manufacturing costs are low.

Next, a fourth embodiment of the invention will be discussed. The embodiment is the same as the first and second embodiments except that a coin transporter in a slot machine differs from that shown in FIG. 2 in constitution. Therefore, we will provide a description centering on the difference therebetween.

Figure 17:
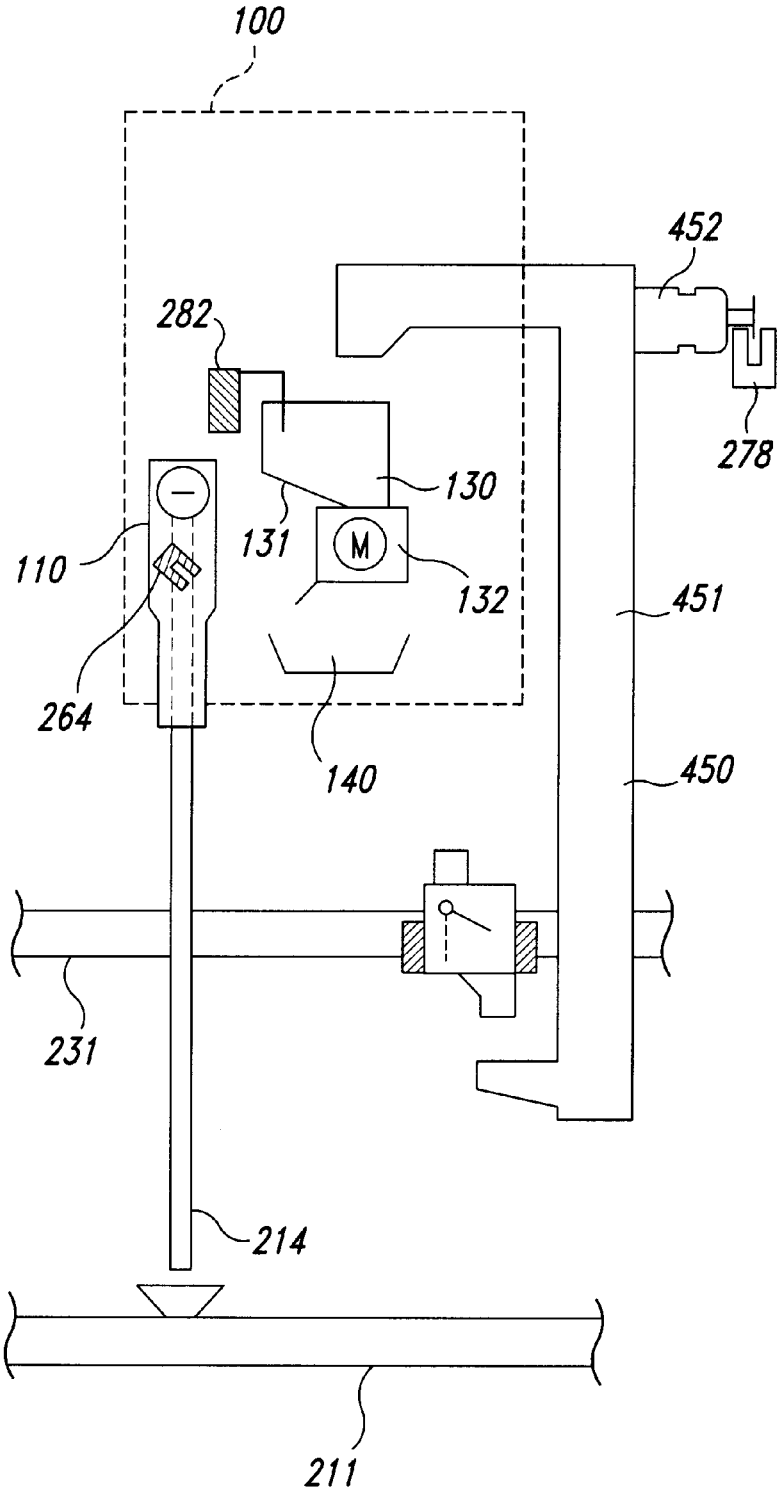
FIG. 17 is an illustration showing the constitution of a slot machine used with a fourth embodiment of the invention.

FIG. 17 shows one slot machine, one coin branch unit, a transporter, a part of a replenishment conveyor, and a part of a collection conveyor in the fourth embodiment of the invention. Like the embodiment shown in FIG. 2, the third embodiment has a number of slot machines and a coin handling mechanism for replenishing the slot machines with coins and collecting coins therefrom although they are not shown. Therefore, the embodiment results from replacing each slot machine in the gaming facility shown in FIG. 2 with the slot machine shown in FIG. 17. Therefore, see FIG. 2 for components other than the slot machines.

The slot machine shown in FIG. 17 has a coin acceptor 110, a game execution section 120, a coin dispenser 130, and a transporter 450.

The coin dispenser 130 in the embodiment has a coin storage section 131 and a coin sending section 132 like that in the first embodiment. The coin storage section 131 is provided with a coin quantity detection sensor 282.

The transporter 450 has a replenishment lift 451 for sending coins to the coin storage section 131 of the coin dispenser 130, a motor 452 for driving the replenishment lift 451, and a motor monitor sensor 278. The replenishment lift 451 is always driven by the motor 452 and when a coin branch unit 250 makes coins branch from a replenishment conveyor 231 into the replenishment lift, the replenishment lift 451 immediately transports the coins to the coin storage section 131 of the coin dispenser 130.

Also in the embodiment, a coin replenishment request and a replenishment stop request are made according to the coin quantity detection sensor 282. A motor error detection process is executed according to a signal based on the motor monitor sensor 278.

The embodiment can also adopt a coin replenishment method similar to that adopted in the second embodiment.

Records of error events stored in predetermined areas of a memory 302 are transferred to and stored in an external storage unit 340 at the house closing time or every given time interval. Preferably, information concerning the numbers of coins calculated and stored by number-of-coins management means, such as the total number of supplied coins, the number of supplied coins for each slot machine, the number of collected coins, the number of input coins, and the number of sales coins, is also transferred to and stored in the external storage unit 340 at the house closing time. Preferably, the numeric values are reported to a host computer through a communication controller 600 as management information. Particularly, the number of sales coins may be reported to the host computer.

In the embodiment, the coin quantity detection sensor 282 for outputting coin replenishment request and replenishment stop request signals is described as a component of the coin handling mechanism 200. However, the coin quantity detection sensor may be included as a component of the slot machine 100.

We claim:

1. A coin handling mechanism being placed in a gaming house having at least one coin game machine group containing a plurality of coin game machines for supplying coins to the coin game machines belonging to the coin game machine group, said coin handling mechanism comprising:

a coin replenishment transporter for transporting coins with which the coin game machines belonging to the coin game machine group are replenished;

a replenishment coin supply unit for storing replenishment coins and supplying coins to said coin replenishment transporter;

coin branch units being provided in a one-to-one correspondence with the coin game machines for making coins transported by said coin replenishment transporter branch therefrom into the corresponding coin game machines; and a controller for at least controlling coin replenishment, said controller comprising:

coin supply control means, upon acceptance of a request for replenishing any coin game machine with coins, for dispensing coins to said coin replenishment transporter from said replenishment coin supply unit;

coin branch control means for accepting a request for replenishing any coin game machine with coins and causing said coin branch unit corresponding to the coin game machine to make coins transported by said coin replenishment transporter branch therefrom into the coin game machine; and duplicate replenishment process inhibition means for inhibiting a duplicate replenishment process of other coin game machines with coins, when said coin branch control means accepts a request for replenishing any coin game machine with coins, until completion of replenishing the coin game machine with coins.

2. The coin handling mechanism as claimed in claim 1 wherein said coin supply control means performs control so as to dispense coins to said coin replenishment transporter from said replenishment coin supply unit until acceptance of a coin replenishment stop request.

3. The coin handling mechanism as claimed in claim 1 wherein said coin branch control means comprises coin replenishment stop process means for stopping the coin branch operation of the coin branch unit corresponding to the coin game machine making a replenishment request after expiration of at least the time equivalent to the time required until the last coin dispensed just before stopping of supply from said replenishment coin supply unit arrives at the coin branch unit and is made to branch by the coin branch unit after coin supply from said replenishment coin supply unit is stopped under the control of said coin supply control means.

4. The coin handling mechanism as claimed in claim 3 wherein said duplicate replenishment process inhibition means releases inhibition of the duplicate replenishment process with coins after the coin branch operation of said coin branch unit is stopped.

5. The coin handling mechanism as claimed in claim 1 wherein said coin branch control means stops the coin branch operation of the coin branch unit corresponding to the coin game machine at a position most distant from said replenishment coin supply unit after expiration of at least the time equivalent to the time required until the last coin dispensed before stopping of supply from said replenishment coin supply unit arrives at the coin branch unit and is made to branch by the coin branch unit, after coin supply from said replenishment coin supply unit is stopped under the control of said coin supply control means.

6. The coin handling mechanism as claimed in claim 5 wherein said duplicate replenishment process inhibition means releases inhibition of the duplicate replenishment process with coins after the coin branch operation of the coin branch unit is stopped.

7. The coin handling mechanism as claimed in claim 3 further including a transporter for transporting coins made to branch by the coin branch unit to an inside of the coin game machine.

8. A coin handling mechanism being placed in a gaming house having at least one coin game machine group containing a plurality of coin game machines for supplying coins to the coin game machine group and collecting coins therefrom, said coin handling mechanism comprising:

a coin replenishment transporter for transporting coins with which the coin game machines belonging to the coin game machine group are replenished;

a replenishment coin supply unit that comprises a coin holding vessel for storing replenishment coins therein and supplies coins stored in said coin holding vessel to said coin replenishment transporter;

a coin collection transporter for receiving coins from the coin game machines belonging to the coin game machine group, transporting and collecting the coins;

a coin lifter that receives the coins transported by said coin collection transporter and transports the coins while lifting up the coins to said coin holding vessel;

a controller for at least controlling coin replenishment;

a spare tank for storing coins not used for replenishment; and a discharge direction switch for switching coins discharged from said replenishment coin supply unit into said coin replenishment transporter or said spare tank, said controller comprising:

coin supply control means, upon acceptance of a request for replenishing any coin game machine with coins, for dispensing coins to said coin replenishment transporter from said replenishment coin supply unit; and switch control means, when sending coins to said spare tank, for controlling said discharge direction switch so as to send coins discharged from said replenishment coin supply unit into said spare tank and controlling operation of said replenishment coin supply unit so as to send coins to said spare tank.

9. The coin handling mechanism as claimed in claim 8 further including coin branch units being provided in a one-to-one correspondence with the coin game machines for making coins transported by said coin replenishment transporter branch therefrom into the corresponding coin game machines, wherein said controller further includes coin branch control means for accepting a request for replenishing any coin game machine with coins and causing said coin branch unit corresponding to the coin game machine to make coins transported by said coin replenishment transporter branch therefrom into the coin game machine.

10. The coin handling mechanism as claimed in claim 8 further including:

a number-of-supplied-coins counter for counting the number of coins discharged from said replenishment coin supply unit; and a number-of-collected-coins counter for counting the number of coins collected at said coin collection transporter, said controller further including number-of-coins management means for managing the number of handled coins, said number-of-coins management means comprising:

number-of-coins-in-spare-tank management means, when coins are sent to said spare tank by switching of said switch, for calculating the number of coins stored in said spare tank from a count just before the coins are sent and a count when the coins have been sent to said spare tank, in said number-of-supplied-coins counter and storing the calculated number of coins;

number-of-collected-coins management means for taking in a count of said number-of-collected-coins counter and storing the count as the number of collected coins; and balance-number-of-collected-coins management means for subtracting the number of coins in said spare tank stored in said number-of-coins-in-spare-tank management means from the number of collected coins stored in said number-of-collected-coins management means for calculating the balance number of collected coins and storing the result.

11. The coin handling mechanism as claimed in claim 8 wherein said replenishment coin supply unit comprises a sensor for detecting excessive storage of coins, and wherein said switch control means comprises means being started when said sensor for detecting excessive storage of coins detects excessive storage of coins for instructing said switch to send coins to said spare tank based on an excessive storage detection signal and when said sensor does not detect excessive storage of coins, for instructing said switch to send coins to said coin replenishment transporter, and means for instructing said replenishment coin supply unit to discharge coins until the excessive storage detection signal disappears when said sensor detects the excessive storage of coins.

12. The coin handling mechanism as claimed in claim 11 further including:

a number-of-supplied-coins counter for counting the number of coins discharged from said replenishment coin supply unit; and a number-of-collected-coins counter for counting the number of coins collected at said coin collection transporter, said controller further including number-of-coins management means for managing the number of handled coins, said number-of-coins management means further comprising:

number-of-coins-in-spare-tank management means, when coins are sent to said spare tank by switching of said switch, for calculating the number of coins stored in said spare tank from a count just before the coins are sent and a count when the coins have been sent to said spare tank, in said number-of-supplied-coins counter and storing the calculated number of coins;

number-of-collected-coins management means for taking in a count of said number-of-collected-coins counter and storing the count as the number of collected coins; and balance-number-of-collected-coins management means for subtracting the number of coins in said spare tank stored in said number-of-coins-in-spare-tank management means from the number of collected coins stored in said number-of-collected-coins management means for calculating the balance number of collected coins and storing the result.

13. The coin handling mechanism as claimed in claim 12 wherein said switch control means is also started when said controller receives a discharge command for discharging sales coins from outside, and is responsive to the command for instructing said switch to send coins to said spare tank and instructing said replenishment coin supply unit to discharge as many coins as the balance number of collected coins stored in said balance-number-of-collected-coins management means.

14. A coin handling mechanism being placed in a gaming house having at least one coin game machine group containing a plurality of coin game machines for supplying coins to the coin game machine group and collecting coins therefrom, said coin handling mechanism comprising:

a replenishment conveyor being placed along the coin game machine group for transporting coins;

a coin holding vessel for storing replenishment coins and discharging coins;

a supply hopper for receiving and temporarily storing the coins discharged from said coin holding vessel and supplying coins to said coin replenishment transporter;

coin branch units being provided in a one-to-one correspondence with the coin game machines and placed along said replenishment conveyor;

a collection conveyor for transporting coins received from the coin game machines;

a coin lifter for further transporting the coins transported on said collection conveyor to said coin holding vessel and storing the coins therein;

a collection passage being placed between a termination of said replenishment conveyor and said collection conveyor for collecting coins not made to branch by said coin branch units and remaining on said replenishment conveyor and guiding the remaining coins to said collection conveyor;

a controller for controlling operation of said components; and a plurality of jam detection sensors being placed at a position where coins shift from said supply hopper to said replenishment conveyor, a position where coins shift from said replenishment conveyor to each coin branch unit, a position where coins shift from said collection passage to said collection conveyor, and a position where coins shift from a termination of said collection conveyor to said coin lifter for detecting a coin jam and sending a coin jam detection signal to said controller;

said controller including jam countermeasure process means for controlling operation of the parts of said coin handling mechanism upon receipt of a coin jam detection signal from any of said jam detection sensors, wherein said jam countermeasure process means previously stores a list of information specifying an equipment whose operation is to be stopped in relation to said jam detection sensors and upon receipt of a jam detection signal from any of said jam detection sensors, reads the information specifying the equipment whose operation is to be stopped corresponding to said jam detection sensor from the stored list and outputs an instruction for stopping the operation to the specified equipment.

15. The coin handling mechanism as claimed in claim 14 wherein each of said jam detection sensors continues to send a coin jam detection signal while detecting a coin jam, and wherein when the coin jam detection signal output from any of said jam detection sensors continues for a first predetermined time, said jam countermeasure process means determines that a jam has occurred, and outputs an operation stop instruction to the specified equipment and after that, when duration of the coin jam detection signal does not reach a second predetermined time, determines that the jam has cleared and releases the operation stop instruction.

16. The coin handling mechanism as claimed in claim 14 wherein each of said replenishment conveyor, said collection conveyor, and said coin lifter comprises a drive motor and a motor monitor sensor for monitoring a rotation state of said motor, wherein said controller further includes motor error countermeasure process means for controlling operation of the parts of said coin handling mechanism upon receipt of a signal indicating a motor rotation error from any of said motor monitor sensors, and wherein said motor error countermeasure process means previously stores a list of information specifying an equipment whose operation is to be stopped in relation to said motor monitor sensors and upon receipt of a signal indicating a motor rotation error from any of said motor monitor sensors, reads the information specifying the equipment whose operation is to be stopped corresponding to said motor monitor sensor from the stored list and outputs an instruction for stopping the operation to the specified equipment.

17. The equipment as claimed in claim 16 whose operation is to be stopped, previously stored in said motor error countermeasure process means, are the equipment previously specified by each motor monitor sensors from among said supply hopper, said replenishment conveyor, said collection conveyor, and said coin lifter, wherein the equipment specified by each motor monitor sensors are: one of the equipment provided with said motor monitor sensors and the equipment preceding said equipment when sequential arrangement of the equipment is in the order of said supply hopper, said replenishment conveyor, said collection conveyor, and said coin lifter.

18. A gaming facility having a coin game machine group to which a plurality of coin game machines belong and a coin handling mechanism for supplying coins to said coin game machines, characterized in that each of said coin game machines comprises:

a coin acceptor for accepting coin input;

a game execution section for executing a predetermined game provided that coin input is accepted by said coin acceptor and outputting a winning signal instructing a predetermined number of coins to be paid out if a player wins a game play; and a coin dispenser for dispensing a predetermined number of coins in response to the winning signal, said coin dispenser having a dispensing hopper for storing at least as many coins as required for one dispensing operation and upon acceptance of winning information, dispensing as many coins as the number specified by the winning information, and that said coin handling mechanism comprises:

a coin replenishment transporter for transporting coins with which said coin game machines are replenished;

a replenishment coin supply unit for storing replenishment coins and supplying coins to said coin replenishment transporter;

coin branch units being provided in a one-to-one correspondence with said coin game machines for making coins transported by said coin replenishment transporter branch therefrom into the corresponding coin dispensers; and a controller for at least controlling coin replenishment, each of said dispensing hoppers having a coin quantity detection sensor for detecting a stored coin quantity, upon detection of the stored coin quantity falling below a predetermined lower limit reference quantity, said coin quantity detection sensor for outputting a coin quantity shortage signal to said controller, upon detection of the stored coin quantity reaching a predetermined upper limit reference quantity, said coin quantity detection sensor for outputting a coin quantity sufficiency signal to said controller, said controller comprising:

coin supply control means, upon receipt of the coin quantity shortage signal as to any coin game machine, for controlling the supply of coins by issuing a coin replenishment request to said replenishment coin supply unit supplying coins from said replenishment coin supply unit to said coin replenishment transporter until acceptance of a request to stop replenishing the coin game machine with coins;

coin branch control means, upon receipt of the coin quantity shortage signal as to any coin game machine, for causing said coin branch unit of said coin game machine provided with said coin quantity detection sensor outputting the coin quantity shortage signal to make coins transported by said coin replenishment transporter branch therefrom;

coin replenishment stop process means, upon receipt of the coin quantity sufficiency signal, for issuing a coin replenishment stop request to said coin supply control means for stopping coin replenishment and after expiration of a predetermined delay time from receiving the coin quantity sufficiency signal, for issuing a coin replenishment stop request to said coin branch control means for stopping the corresponding coin branch unit making coins branch; and duplicate replenishment process inhibition means for inhibiting a duplicate replenishment process of other coin game machines with coins, when said coin branch control means accepts a request for replenishing any coin game machine with coins, until completion of replenishing the coin game machine with coins.

19. The gaming facility as claimed in claim 18 wherein said duplicate replenishment process inhibition means releases inhibition of the duplicate replenishment process with coins after the coin branch operation of said coin branch unit is stopped.

20. The gaming facility as claimed in claim 19 wherein the delay time of said coin replenishment stop process means is set to the time equivalent to the time required until the last of coins dispensed from said replenishment coin supply unit to said coin replenishment transporter just before a replenishment stop instruction of said coin supply control means arrives at said coin branch unit of said coin game machine at a position most distant from said replenishment coin supply unit and is made to branch by said coin branch unit.

21. The gaming facility as claimed in claim 20 wherein said duplicate replenishment process inhibition means releases inhibition of the duplicate replenishment process with coins after the coin branch operation of said coin branch unit is stopped.

22. A gaming facility having a coin game machine group to which a plurality of coin game machines belong and a coin handling mechanism for supplying coins to said coin game machines, characterized in that each of said coin game machines comprises:

a coin acceptor for accepting coin input;

a game execution section for executing a predetermined game provided that coin input is accepted by said coin acceptor and outputting a winning signal instructing a predetermined number of coins to be paid out if a player wins a game play; and a coin dispenser for dispensing a predetermined number of coins in response to the winning signal, and that said coin handling mechanism comprises:

a coin replenishment transporter for transporting coins with which said coin game machines are replenished;

a replenishment coin supply unit that comprises a coin holding vessel for storing replenishment coins therein and supplies coins stored in said coin holding vessel to said coin replenishment transporter;

a coin collection transporter for transporting and collecting coins that at least receives coins from said coin acceptor to transport and collect the coins;

a coin lifter that receives the coins transported by said coin collection transporter and transports the coins while lifting up the coins to said coin holding vessel;

coin branch units being provided in a one-to-one correspondence with said coin game machines for making coins transported by said coin replenishment transporter branch therefrom into the corresponding coin dispensers; and a controller for at least controlling coin replenishment, said coin handling mechanism further including:

a spare tank for storing coins; and a discharge direction switch being located between said replenishment coin supply unit and said coin replenishment transporter for switching coins discharged from said replenishment coin supply unit into said coin replenishment transporter or said spare tank, said controller comprising:

coin supply control means, upon acceptance of a request for replenishing any coin game machine with coins, for dispensing coins to said coin replenishment transporter from said replenishment coin supply unit;

coin branch control means, upon acceptance of a request for replenishing any coin game machine with coins, for causing said coin branch unit corresponding to the coin game machine outputting the replenishing request signal to make coins transported by said coin replenishment transporter branch therefrom; and switch control means, when sending coins to said spare tank, for controlling said discharge direction switch so as to switch coins discharged from said replenishment coin supply unit into said spare tank and controlling operation of said replenishment coin supply unit so as to send coins to said spare tank.

23. The gaming facility as claimed in claim 22 wherein said replenishment coin supply unit comprises a sensor for detecting excessive storage of coins stored therein, and wherein said switch control means comprises means being started when said sensor for detecting excessive storage of coins detects excessive storage of coins for instructing said switch to send coins to said spare tank based on an excessive storage detection signal and when said sensor does not detect excessive storage of coins, for instructing said switch to send coins to said coin replenishment transporter, and means for instructing said replenishment coin supply unit to discharge coins until the excessive storage detection signal disappears when said sensor detects the excessive storage of coins.

24. The gaming facility as claimed in claim 23 further including:

a number-of-supplied-coins counter for counting the number of coins discharged from said replenishment coin supply unit; and a number-of-collected-coins counter for counting the number of coins collected at said coin collection transporter said number-of-supplied-coins counter being placed at a position where coins are discharged from said supply hopper, said controller further including number-of-coins management means for managing the number of handled coins, said number-of-coins management means comprising:

number-of-coins-in-spare-tank management means, when coins are sent to said spare tank by switching of said switch, for calculating the number of coins stored in said spare tank from a count just before the coins are sent and a count when the coins have been sent to said spare tank, in said number-of-supplied-coins counter and storing the calculated number of coins;

number-of-collected-coins management means for taking in a count of said number-of-collected-coins counter and storing the count as the number of collected coins; and balance-number-of-collected-coins management means for subtracting the number of coins in said spare tank stored in said number-of-coins-in-spare-tank management means from the number of collected coins stored in said number-of-collected-coins management means for calculating the balance number of collected coins and storing the result.

25. The gaming facility as claimed in claim 24 wherein said replenishment coin supply unit comprises a sensor for detecting excessive storage of coins stored therein, and wherein said switch control means is also started when said controller receives a discharge command for discharging sales coins from an outside, and is responsive to the command for instructing said switch to send coins to said spare tank and instructing said replenishment coin supply unit to discharge as many coins as the balance number of collected coins stored in said balance-number-of-collected-coins management means.

26. A coin handling mechanism being placed in a gaming house having at least one coin game machine group containing a plurality of coin game machines for supplying coins to the coin game machines belonging to the coin game machine group, said coin handling mechanism comprising:

a coin replenishment transporter for transporting coins with which the coin game machines belonging to the coin game machine group are replenished;

a replenishment coin supply unit for storing replenishment coins and supplying coins to said coin replenishment transporter;

coin branch units being provided in a one-to-one correspondence with the coin game machines for making coins transported by said coin replenishment transporter branch therefrom into the corresponding coin game machines;

a controller for at least controlling coin replenishment, said controller comprising:

coin branch control means for accepting a request for replenishing any coin game machine with coins and causing said coin branch unit corresponding to the coin game machine to make coins transported by said coin replenishment transporter branch therefrom into the coin game machine; and duplicate replenishment process inhibition means for inhibiting a duplicate replenishment process of other coin game machines with coins, when said coin branch control means accepts a request for replenishing any coin game machine with coins, until completion of replenishing the coin game machine with coins.

27. The coin handling mechanism as claimed in claim 26 further including a number-of-supplied-coins counter for counting the number of coins discharged from said replenishment coin supply unit, wherein said controller comprises coin supply control means for accepting a request for replenishing any coin game machine with coins and dispensing a predetermined number of coins to said coin replenishment transporter from said replenishment coin supply unit by making reference to a count of said number-of-supplied-coins counter.

28. The coin handling mechanism as claimed in claim 27 wherein said coin branch control means comprises means for stopping the coin branch operation of the coin branch unit corresponding to the coin game machine making a replenishment request after expiration of at least the time equivalent to the time required until the last coin dispensed arrives at the coin branch unit and is made to branch by the coin branch unit after a predetermined number of coins are dispensed from said replenishment coin supply unit to said coin replenishment transporter under the control of said coin supply control means.

29. A gaming facility having a coin game machine group to which a plurality of coin game machines belong and a coin handling mechanism for supplying coins to said coin game machines, characterized in that each of said coin game machines comprises:

a coin acceptor for accepting coin input;

a game execution section for executing a predetermined game provided that coin input is accepted by said coin acceptor and outputting a winning signal instructing a predetermined number of coins to be paid out if a player wins a game play; and a coin dispenser for dispensing a predetermined number of coins in response to the winning signal, said coin dispenser having a dispensing hopper for storing at least as many coins as required for one dispensing operation, and upon acceptance of winning information, dispensing as many coins as the number specified by the winning information, and that said coin handling mechanism comprises:

a coin replenishment transporter for transporting coins with which said coin game machines are replenished;

a replenishment coin supply unit for storing replenishment coins and supplying coins to said coin replenishment transporter;

coin branch units being provided in a one-to-one correspondence with said coin game machines for making coins transported by said coin replenishment transporter branch therefrom into the corresponding coin dispensers;

a number-of-supplied-coins counter for counting the number of coins discharged from said replenishment coin supply unit; and a controller for at least controlling coin replenishment, said controller comprising:

coin supply control means for accepting a request for replenishing any coin game machine with coins and dispensing a predetermined number of coins to said coin replenishment transporter from said replenishment coin supply by making reference to a counter of said number-of-supplied-coins counter;

coin branch control means for accepting a request for replenishing any coin game machine with coins and causing said coin branch unit corresponding to the coin game machine to make coins transported by said coin replenishment transporter branch therefrom into the coin game machine; and duplicate replenishment process inhibition means for inhibiting a duplicate replenishment process of other coin game machines with coins, when said coin branch control means accepts a request for replenishing any coin game machine with coins, until completion of replenishing the coin game machine with coins.

30. The gaming facility as claimed in claim 29 wherein each of said dispensing hoppers has a coin quantity detection sensor for detecting a stored coin quantity, upon detection of the stored coin quantity falling below a predetermined lower limit reference quantity, said coin quantity detection sensor for outputting a coin quantity shortage signal to said controller, and wherein when receiving the coin quantity shortage signal, said controller starts said coin supply control means and said coin branch control means and issues a coin replenishment request for dispensing coins from said replenishment coin supply unit to said coin replenishment transporter and causing said coin branch unit of said coin game machine provided with said coin quantity detection sensor outputting the coin quantity shortage signal to make coins transported by said coin replenishment transporter branch therefrom.

31. The gaming facility as claimed in claim 30 wherein said coin branch control means comprises means for stopping the coin branch operation of the coin branch unit corresponding to the coin game machine making a replenishment request after expiration of at least the time equivalent to the time required until the last coin dispensed arrives at the coin branch unit and is made to branch by the coin branch unit after a predetermined number of coins are dispensed from said replenishment coin supply unit to said coin replenishment transporter under the control of said coin supply control means.

32. The gaming facility as claimed in claim 31 wherein said duplicate replenishment process inhibition means releases inhibition of the replenishment process with coins after the coin branch operation of said coin branch unit is stopped.

33. A coin handling mechanism being placed in a gaming house having at least one coin game machine group containing a plurality of coin game machines for at least replenishing the coin game machines belonging to the coin game machine group with coins, said coin handling mechanism comprising:

an equipment group containing a plurality of equipment for at least replenishing the coin game machines with coins;

a controller for controlling operation of said equipment group; and a plurality of jam detection sensors being placed at a plurality of points of said equipment group each for detecting a coin jam and sending a coin jam detection signal to said controller, said controller having jam countermeasure process means for controlling operation for said equipment group upon receipt of a coin jam detection signal from any of said jam detection sensors, said jam countermeasure process means having means for previously storing a list of information specifying the equipment in said equipment group whose operation is to be stopped in relation to said jam detection sensors and means, upon receipt of a jam detection signal from any of said jam detection sensors, for reading the information specifying the equipment whose operation is to be stopped corresponding to said jam detection sensor from the stored list and outputting an instruction for stopping the operation to the specified machines.

34. The coin handling mechanism as claimed in claim 33 wherein each of said jam detection sensors continues to send a coin jam detection signal while detecting a coin jam, and wherein when the coin jam detection signal output from any of said jam detection sensors continues for a first predetermined time, said jam countermeasure process means determines that a jam has occurred, and outputs an operation stop instruction to the specified equipment and after this, when duration of the coin jam detection signal does not reach a second predetermined time, determines that the jam has cleared and releases the operation stop instruction.

35. A coin handling mechanism being placed in a gaming house having at least one coin game machine group containing a plurality of coin game machines for at least replenishing the coin game machines belonging to the coin game machine group with coins, said coin handling mechanism comprising:

a machine group containing a plurality of equipment for at least replenishing the coin game machines with coins, at least some of the equipment in said equipment group having a motor;

a controller for controlling operation of said equipment group; and motor monitor sensors for monitoring a rotation state for each motor contained in said equipment group, said controller further including motor error countermeasure process means for controlling operation of said equipment group upon receipt of a signal indicating a motor rotation error from any of said motor monitor sensors, said motor error countermeasure process means having means for previously storing a list of information specifying an equipment whose operation is to be stopped in relation to said motor monitor sensors and means, upon receipt of a signal indicating a motor rotation error from any of said motor monitor sensors, for reading the information specifying the equipment whose operation is to be stopped corresponding to said motor monitor sensor from the stored list and outputting an instruction for stopping the operation to the specified equipment.

* * * * *